US007101322B2

(12) United States Patent
Carle

(10) Patent No.: US 7,101,322 B2
(45) Date of Patent: Sep. 5, 2006

(54) WEIGHT EXERCISE DEVICE

(76) Inventor: John T. Carle, 1423 Mox Chehalis Rd., McCleary, WA (US) 98557

( * ) Notice: Subject to any disclaimer, the term of this patent is extended or adjusted under 35 U.S.C. 154(b) by 108 days.

(21) Appl. No.: 11/025,300

(22) Filed: Dec. 29, 2004

(65) Prior Publication Data

US 2005/0148445 A1 Jul. 7, 2005

Related U.S. Application Data

(60) Provisional application No. 60/534,779, filed on Jan. 5, 2004.

(51) Int. Cl.
*A63B 21/00* (2006.01)

(52) U.S. Cl. ..... 482/97; 482/98; 482/100

(58) Field of Classification Search ..... 482/94, 482/97–98, 100, 138, 139, 62, 72, 101, 136–7
See application file for complete search history.

(56) References Cited

U.S. PATENT DOCUMENTS

| | | | | |
|---|---|---|---|---|
| 2,932,509 A | | 4/1960 | Zinkin | |
| 3,905,599 A | * | 9/1975 | Mazman | 482/98 |
| 4,093,213 A | | 6/1978 | Coker et al. | |
| 4,211,403 A | | 7/1980 | Coffaro et al. | |
| 4,226,414 A | | 10/1980 | Coffaro et al. | |
| 4,546,970 A | | 10/1985 | Mahnke | |
| 4,600,188 A | * | 7/1986 | Bangerter et al. | 482/79 |
| 4,951,970 A | | 8/1990 | Burt | |
| 5,358,462 A | | 10/1994 | Calderone | |
| 5,529,558 A | | 6/1996 | Koenig | |
| 5,688,216 A | | 11/1997 | Mauriello | |
| 5,702,329 A | | 12/1997 | Koenig | |
| 5,749,813 A | * | 5/1998 | Domzalski | 482/97 |
| 5,788,616 A | | 8/1998 | Polidi | |
| 6,264,585 B1 | * | 7/2001 | Beauchamp | 482/72 |

(Continued)

FOREIGN PATENT DOCUMENTS

GB 2148726 A * 6/1985

*Primary Examiner*—Stephen R. Crow
*Assistant Examiner*—Allana Lewin
(74) *Attorney, Agent, or Firm*—Brian J. Coyne

(57) ABSTRACT

A weight training device for providing substantially uniform resistance throughout the range of motion of each of a variety of weight lifting exercises. Upstanding front and rear stanchions are attached to front and rear portions of a base, respectively. In a first embodiment, the front stanchion is rigidly attached to the base, the rear stanchion is pivotally attached to the base, and a lever arm assembly is pivotally attached to the front stanchion and includes a dolly cage attached to the rear stanchion that forces the rear stanchion to pivot toward and away from the front stanchion as the assembly is pivoted in a vertical plane by a weight trainee against the resistance of weight suspended from the assembly. In a second embodiment, the front stanchion is mounted for reciprocal, vertical motion on a rod attached to the base. A plurality of weight plates are disposed below the front stanchion in vertical, stacked relation, any or all of which can be suspended from the front stanchion by insertion of a stack pin through any one of the plates and into an aperture in a stack pin rod suspended from the front stanchion. A lever arm assembly has a front portion pivotally attached to the front stanchion and a rear portion pivotally attached to the rear, pivoting stanchion, such that when a trainee pivots the assembly in a vertical plane against the resistance of the weights, the rear stanchion pivots toward the front stanchion.

28 Claims, 24 Drawing Sheets

U.S. PATENT DOCUMENTS 6,361,481 B1 3/2002 Koenig
6,482,135 B1 * 11/2002 Ish et al. ..... 482/97
6,575,880 B1 * 6/2003 Hengtrakulsin ..... 482/97
6,994,660 B1 * 2/2006 Ish et al. ..... 482/98

* cited by examiner

WEIGHT EXERCISE DEVICE

CROSS REFERENCE TO RELATED APPLICATIONS

This application is related to U.S. provisional patent application No. 60/534,779 by the same applicant with filing date Jan. 5, 2004.

STATEMENT REGARDING FEDERALLY APPROVED RESEARCH OR DEVELOPMENT

None.

BACKGROUND OF THE INVENTION

1. Field of the Invention

This invention relates to body exercising apparatus and more particularly to weight exercise machines that provide a substantially uniform resistance throughout the range of motion of each of several different kinds of weight lifting exercises.

2. Background Art

Weight lifting exercises have long proven effective for muscle and general body building. For a weight trainee who is a trained athlete or who has otherwise acquired adequate strength and muscle conditioning, bar bells and dumbbells can be used in performing bench presses, leg squats, biceps curls, triceps extensions and other weight training exercises. Bar bells and dumbbells, however, can inadvertently fall or be dropped, possibly resulting in bodily injury or property damage; and, the danger of their falling or being dropped is higher when used by new and unconditioned weight trainees. A variety of weight training devices that substantially eliminate that danger while at the same time simulating the lifting of a barbell or dumbbells have been disclosed, of which the following references are exemplary: U.S. Pat. No. 458,382 to Zander; U.S. Pat. No. 2,93,509 to Zinkin; U.S. Pat. No. 4,093,213 to Coker et al.; U.S. Pat. Nos. 4,211,403 and 4,226,414 to Coffaro et al.; U.S. Pat. No. 5,358,462 to Calderone; U.S. Pat. No. 5,788,616 to Polidi; U.S. Pat. No. 5,688,216 to Mauriello; and U.S. Pat. No. 6,361,481 B1 to Koenig. These and similar weight training devices of the prior art provide a body-engaging means attached to a first end of a pivot arm or lever, means for pivoting the lever, and weight resistance means attached to a second, opposite end of the lever, with the result that, as a weight trainee moves the body-engaging means through the range of motion of a selected weight lifting exercise, the degree of resistance the trainee experiences varies through the range of motion of the exercise, and generally not in any optimal way. This problem was addressed by Mahnke in U.S. Pat. No. 4,546,970, who disclosed a weight type exercising device wherein the effective length of the lever arm is changed during the range of motion of a weight lifting exercise so as to continuously vary the resistance through the range of motion in a way considered by Mahnke to be closer to optimal. In U.S. Pat. No. 5,529,558, Koenig disclosed a weight lifting device, specialized for squatting and heel raising exercises wherein the body-engaging means was a pair of padded shoulder bars mounted to a first end of a pivot arm, weight suspending means being affixed to an intermediate portion of the pivot arm, and the pivoting arm rose up and down a pivotable mast. The effective length of the pivot arm was thereby varied such that the resistance experienced by the weight trainee at the bottom of a squat was minimized and the resistance increased as the trainee moved the body-engaging means upward and rose to a standing position. This variation in experienced resistance was considered desirable by Koenig because the effective leg strength of the trainee is least at the bottom of a leg squat.

The exercise devices of Mahnke and of Koenig do not satisfactorily solve the problem presented, however. Many weight lifting devotees, especially those who engage in competitive weight lifting competitions, prefer to experience uniform resistance throughout the range of motion of each weight lifting exercise because that best simulates what is experienced when one is actually lifting barbells and dumbbells. Moreover, the devices of Mahnke and Koenig can only be used for a relatively few kinds of weight lifting exercises; they are not suitable, for example, for triceps extensions or arm curls. What is particularly desired, and what Mahnke and Koenig have failed to provide, is a single weight exercise device that is designed to train every body part and upon which as many as forty weight lifting exercises can be performed, and through which device a weight lifting trainee experiences substantially uniform resistance throughout the range of motion of each exercise.

SUMMARY OF THE INVENTION

It is, therefore, an object of the invention to provide a weight exercise device upon which a weight lifting trainee can perform a substantial variety of standard weight lifting exercises and experience substantially uniform resistance throughout the range of motion of each exercise.

A further object is to provide such a device that is compact and conveniently stores its weights when the weights are not in use and in a way that does not interfere with any exercise movements.

Still another object is to provide such a device that has a base having a front end portion and a longitudinally-opposite rear end portion; a front, upstanding stanchion having a lower end attached to the front end portion of the base, said stanchion having a first set of vertically spaced-apart, laterally-directed apertures; a rear, pivoting stanchion spaced rearward from the front stanchion and having a lower end pivotally attached to a rear end portion of the base for movement coplanar with the front stanchion and an upper free end, said rear, pivoting stanchion having a second set of vertically spaced-apart, laterally directed apertures; a laterally-directed lever arm assembly pivot pin; a lever arm assembly longitudinally disposed and coplanar with the front and rear stanchions and pivotally attached to one of the stanchions for pivotal movement in a vertical plane at any of a selected one of the apertures of said one of the stanchion by insertion of a lever arm assembly pin through a first lateral bore in said assembly and into said one of the laterally-directed apertures of said one of the stanchions, said assembly including means for attaching said assembly to the other stanchion, said means permitting vertical travel of said means; body engaging means; means for attaching the body engaging means to the lever arm assembly; and means for suspending weights from the lever arm assembly.

It is another object to provide such a device wherein, in a first embodiment, the lever arm assembly is pivotally attached to the front stanchion, the means for attaching the assembly to the other stanchion is attached to the rear, pivoting stanchion, and the means for suspending the weights from the lever arm assembly is attached to a rear portion of the lever arm assembly.

Another object is to provide such a device wherein, in a second embodiment, the lever arm assembly is pivotally attached to the rear, pivoting stanchion, the means for attaching said assembly to the other stanchion is attached to the front stanchion, and the means for suspending weights from the lever arm assembly is attached to a front portion of the lever arm assembly.

It is a further object to provide such a device wherein, in a first embodiment, the means for suspending the weights includes a rear beam that extends rearward from the rear stanchion, said rear beam having a second lateral bore, the body engaging means includes a front beam that extends frontward from the front stanchion, and the lever arm assembly includes a dolly cage intermediate the front and rear beams and joining them, said dolly cage being mounted for vertical travel up and down the rear, pivoting stanchion; and a safety spotter pin insertable through a selected one of the first set of apertures below the front beam for supporting the lever arm assembly; and wherein further the dolly cage includes a pair of longitudinally-directed, laterally spaced-apart members, said members having front ends joined by a front spacer, and rear ends joined by a rear spacer, and a pair of rollers disposed intermediate the front and rear spacers and mounted for rotation on axles attached to the front and rear spacers, said rollers being longitudinally spaced apart to define an opening, in cooperation with the members, sufficient to receive the rear, pivoting stanchion therewithin, and wherein the front spacer is attached to the front beam and the rear spacer is attached to the rear beam.

Still another object is to provide such a device in a second embodiment, wherein the front stanchion is a vertically moveable tube and the means for suspending weights from the front end portion of the lever arm assembly includes an upstanding frame attached to the base, said frame including a pair of laterally spaced-apart, vertical support columns, and a laterally-disposed cross bar attached to upper ends of the support columns, said cross bar having a horizontal header with an opening; a pair of laterally spaced-apart guide rods that extend upward from the base to the header; a stack pin rod intermediate the guide rods that extends downward from the header and has a free lower end; wherein, the front stanchion is vertically movable and is extendable upward through the opening in the header; a stack pin; and a weight stack comprised of a plurality of weight plates in vertical, stacked relation such that the upper weights of the stack rest upon the lower weights of the stack, each plate having a pair of laterally spaced-apart openings and a central opening, said weight stack being mounted for slidable, vertical movement along the guide rods, and each plate having a longitudinally-directed aperture adapted to receive the stack pin, such that insertion of the stack pin through a selected plate and through an aligned aperture of the stack pin rod attaches said plate, and all weight plates that rest thereon, to the front stanchion.

Another object is to provide such a device in said second embodiment, wherein the lever arm assembly includes a parallel pair of laterally-spaced apart longitudinal members joined at a rear end thereof by a rear member and joined at a front end thereof by a front member; means for pivotally attaching a front portion of said assembly to the front stanchion; and means for pivotally attaching a rear portion of said assembly to the rear stanchion.

A further object is to provide such a device in said second embodiment, wherein the means for attaching a front portion of said assembly to the front stanchion includes an upstanding front collar disposed at a front portion of the assembly between the longitudinal members and rear-adjacent to the front member, said collar defining an opening adapted to receive and encircle the front stanchion, said collar having a laterally-directed front collar bore and a pair of laterally and oppositely-directed studs; a front collar pin inserted through the front collar bore and insertable into any one of the front set of apertures for pivotally attaching the assembly to the front stanchion; and wherein the means for attaching a rear portion of said assembly to the rear stanchion includes an upstanding rear collar disposed at a rear portion of the assembly between the longitudinal members and front-adjacent to the rear member, said collar defining an opening adapted to receive and encircle the rear stanchion, said collar having a laterally-directed rear collar bore and a pair of laterally and oppositely-directed studs, and a rear collar pin inserted through the rear collar bore and insertable into any one of the second set of apertures for pivotally attaching the assembly to the rear stanchion; and wherein further the longitudinal members have recesses that receive said studs; whereby the collars are pivotable in a vertical plane about said studs, the front portion of the assembly can travel up and down with the pivotally attached front stanchion together with such portion of the weight stack that is attached to the front stanchion, and the rear portion of the assembly is pivotally attached to the rear stanchion.

A further object is to provide such a device in said first and second embodiments, wherein the first set of apertures are sequentially labeled by letters in alphabetical order and the second set of apertures are sequentially labeled by numerals in numerical order, or vice-versa, to facilitate recording the pivot positions of the lever arm assembly that are determined to be optimal for a given trainee while performing each one of a set of weight lifting exercises.

BRIEF DESCRIPTION OF THE DRAWINGS

FIG. 1(*b*) is a side elevational, perspective view of a trainee performing a triceps extension exercise on the first embodiment, wherein the upper extent of the range of motion of the trainee is depicted;

FIG. 1(*c*) is a side elevational, perspective view of a trainee performing a triceps extension exercise on the first embodiment, wherein the lower extent of the range of motion of the trainee is depicted;

Figure 1A:
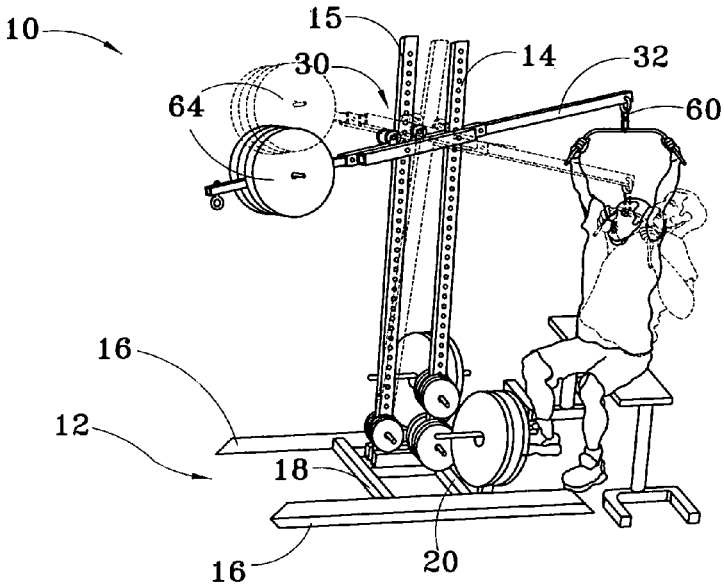
FIG. 1(*a*) is a side elevational, perspective view of a trainee seated on a bench and performing pull down exercises on a first embodiment of the device throughout a reciprocating range of motion of the trainee, the lower and upper extent of which ranges of motion are indicated by phantom lines and solid lines, respectively.
Figure 1B:
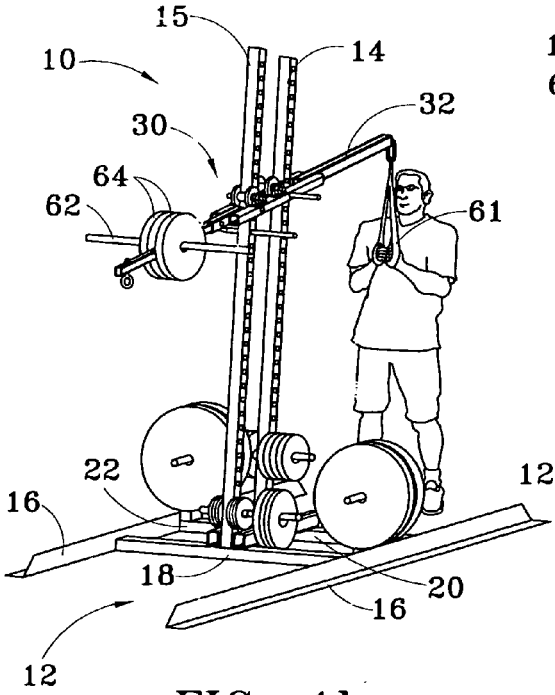
Figure 1C:
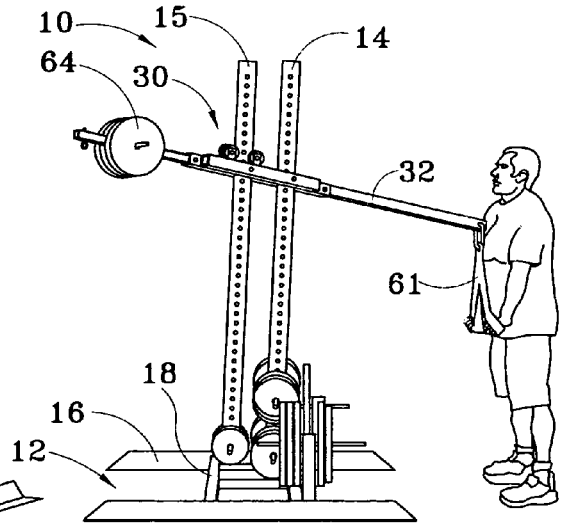
Figure 9:
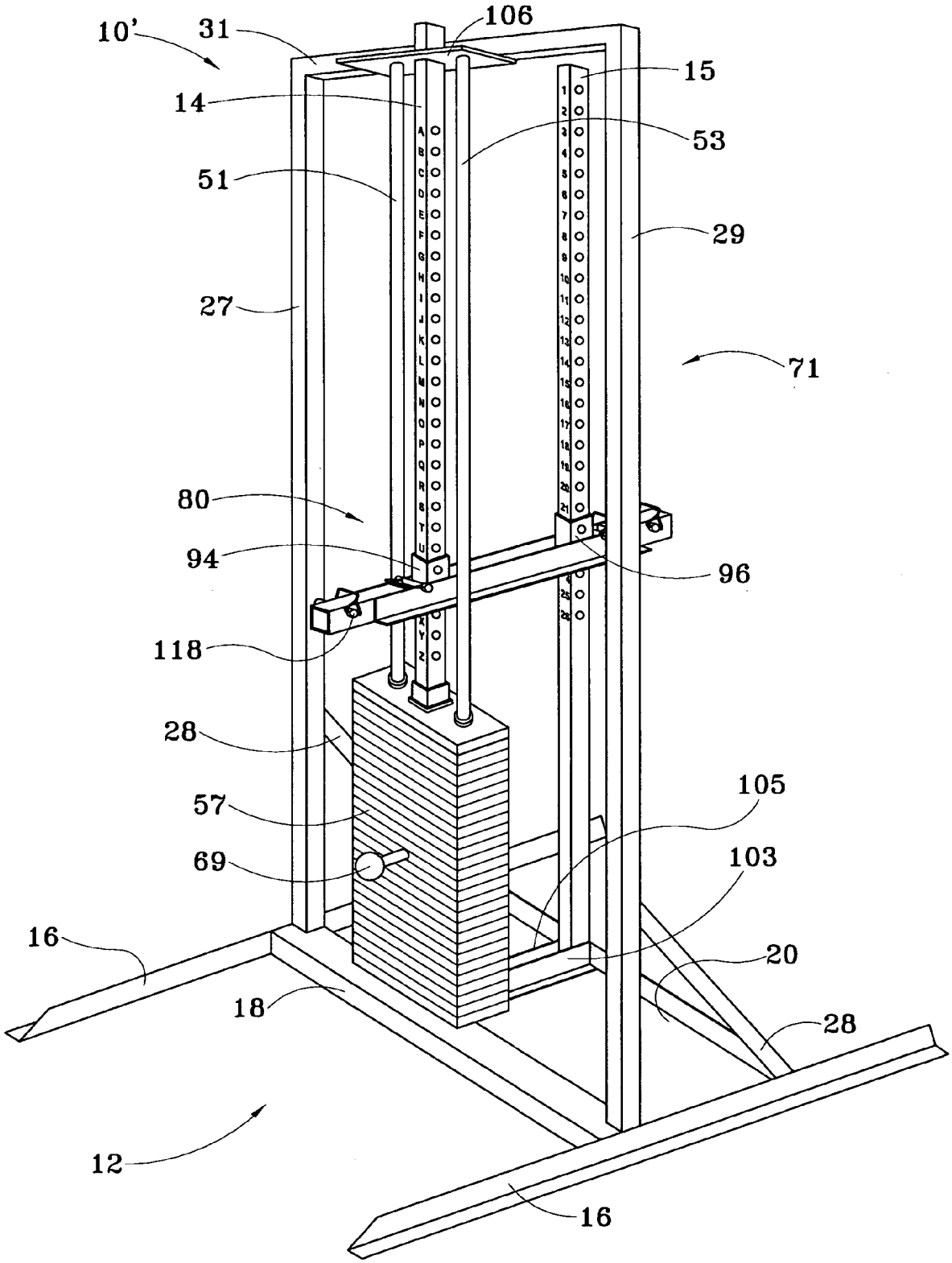
FIG. 9 is a frontal perspective thereof showing the lever arm assembly mounted lower on the front and rear stanchions, suitable for performing bench presses and squats at the front of the device.

In the case of the first embodiment of the device, the terms "front" and "rear" refer to the right and left portions of the device as depicted in FIG. 1, respectively. In the case of the second embodiment of the device, the terms "front" and "rear" refer to the leftmost and rightmost portions of the device as depicted in FIG. 9.

MODES OF PRACTICING THE INVENTION

Referring now to FIGS. 1–6, a first embodiment of my weight exercise device, denoted generally by the numeral 10. For illustrative purposes only, the device is shown in FIGS. 1(*a*), 1(*b*), 1(*c*) and 1(*d*) in use by a trainee engaged in pulldowns (FIGS. 1(*a*) and 1(*b*)) and triceps extension (FIGS. 1(*c*) and 1(*d*), but the device is very versatile and can be used in an additional thirty-eight other kinds of weight lifting exercises. The device 10 comprises a base 12, a front, upstanding stanchion 14 that has a first, lower end rigidly attached to the base 12 and an opposite free end; a rear, pivoting stanchion 15 spaced rearward from and coplanar with the front stanchion 14, and has a lower end pivotally attached to the base; and a longitudinally-elongated lever arm assembly 30. As may best be seen in FIG. 6, the base 12 includes a pair of longitudinally-directed, laterally spaced-apart angle irons 16 joined by a parallel pair of laterally directed, spaced-apart, cross beams 18, 20 of equal length. A pair of longitudinally-directed, rectangular tubes 43, 45 extend across, and are attached to, the cross beams 18, 20. Just below the tubes 43, 45 are another pair of longitudinally-directed rectangular tubes 44, 46, respectively, that extend between and are attached to the cross beams 18, 20. The lower end of the pivoting stanchion 15 is pivotally attached to the base 12 by pivot pin 47 laterally inserted through aligned apertures (not shown) in said lower end and apertures in the tubes 44, 46. A lower end portion of the front stanchion 14 is rigidly attached to the tubes 44, 46. The front, fixed stanchion 14 and the rear, pivoting stanchion 15 each have a plurality of vertically spaced-apart, laterally-directed apertures 21; said apertures 21 on each of the stanchions 14, 15 are labeled substantially from the top end to the bottom ends thereof by indicia, preferably by alphabetic indicia 23 and numerical indicia 25, respectively. As depicted, the first set of apertures 21 on the front stanchion 14 are sequentially labeled with letters in alphabetic order and the second set of apertures 21 on the rear stanchion 15 are sequentially labeled with numerals; alternatively, the first set 21 can be sequentially labeled numerically and the second set 21 can be sequentially labeled alphabetically.

Figure 2:
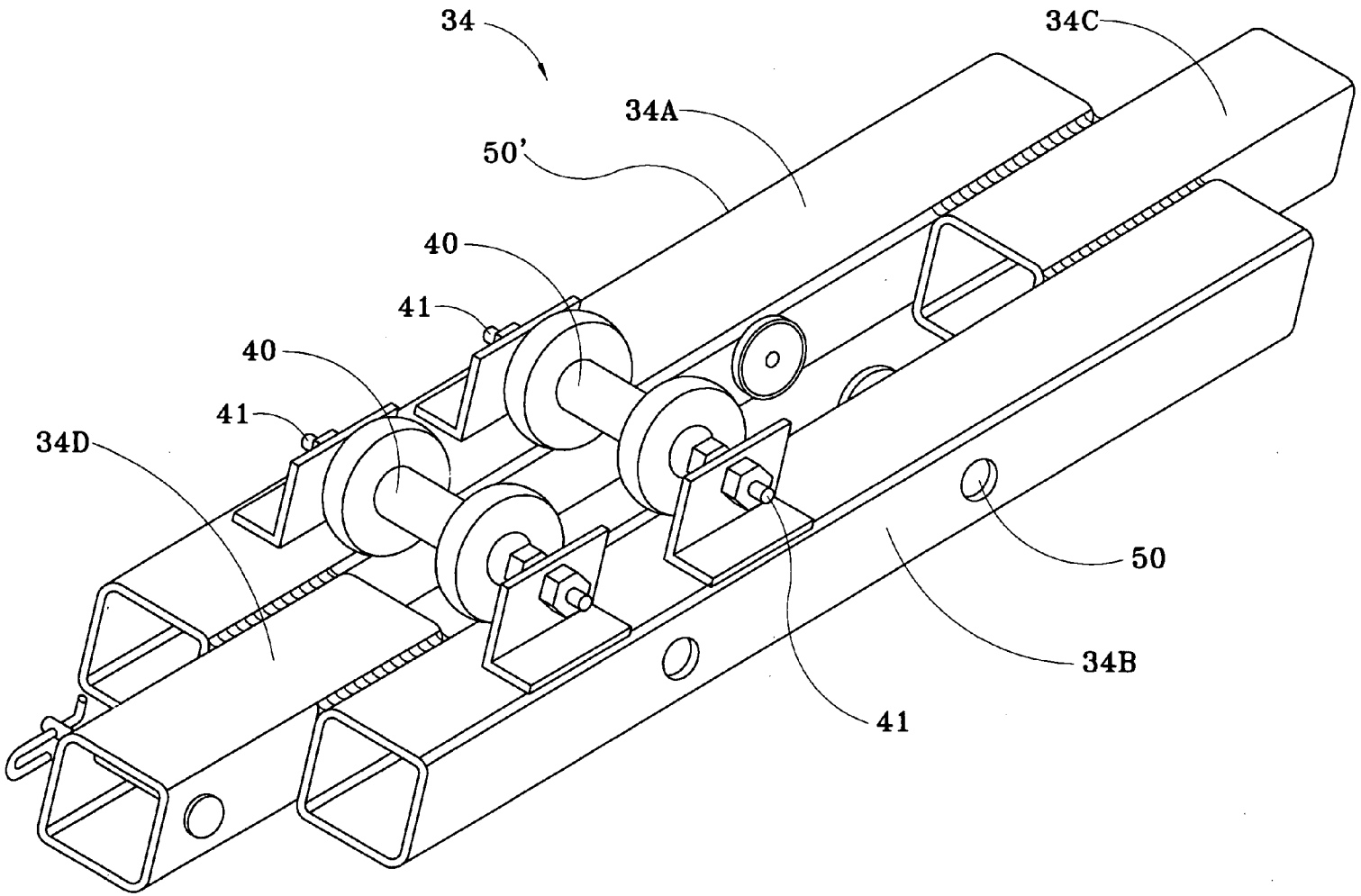
FIG. 2 is an enlarged, lever arm assembly thereof removed from the device.
Figure 3:
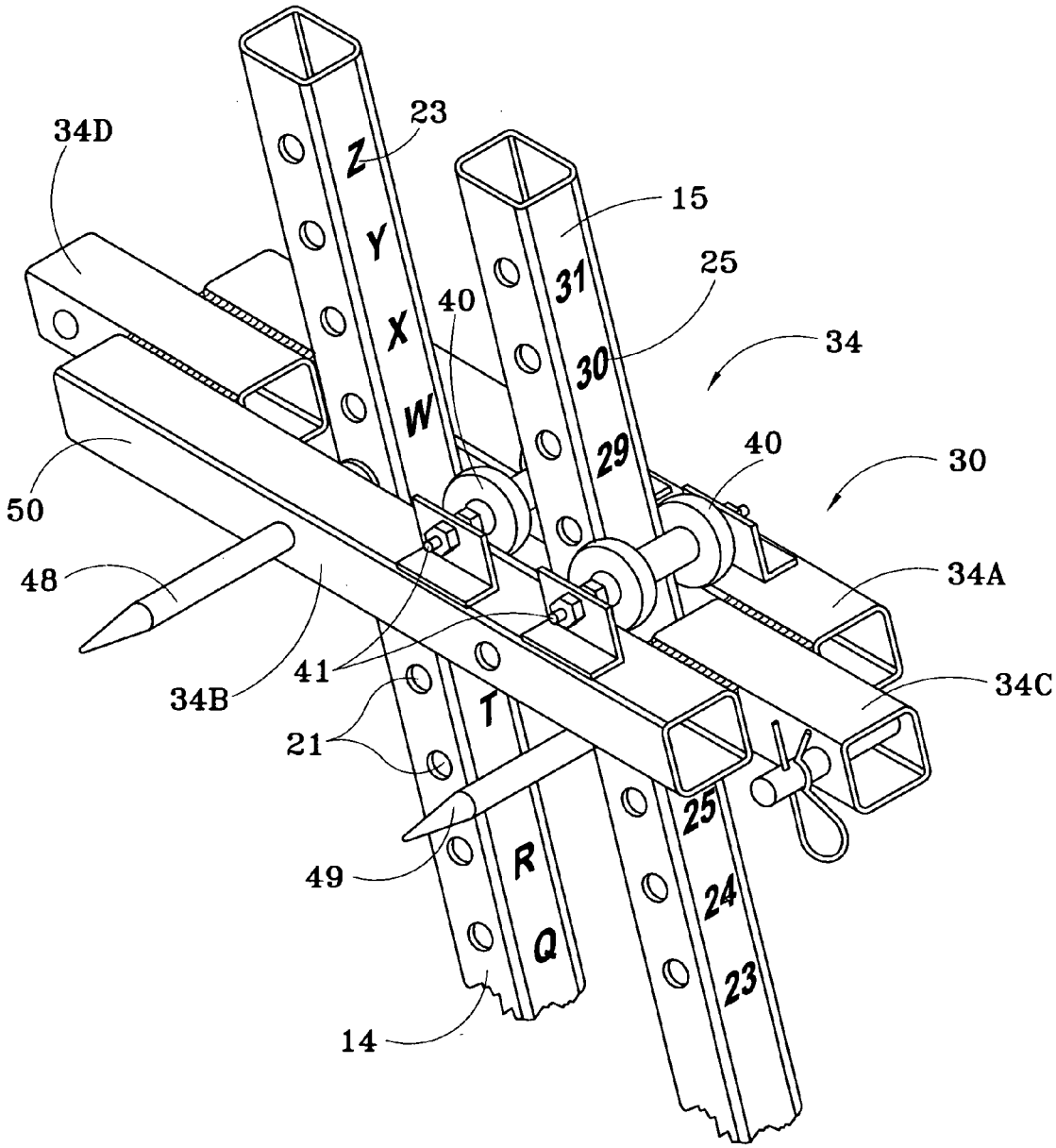
FIG. 3 is an enlarged, fragmentary, side elevational perspective view thereof showing the lever arm assembly mounted to the front and rear stanchions.
Figure 4:
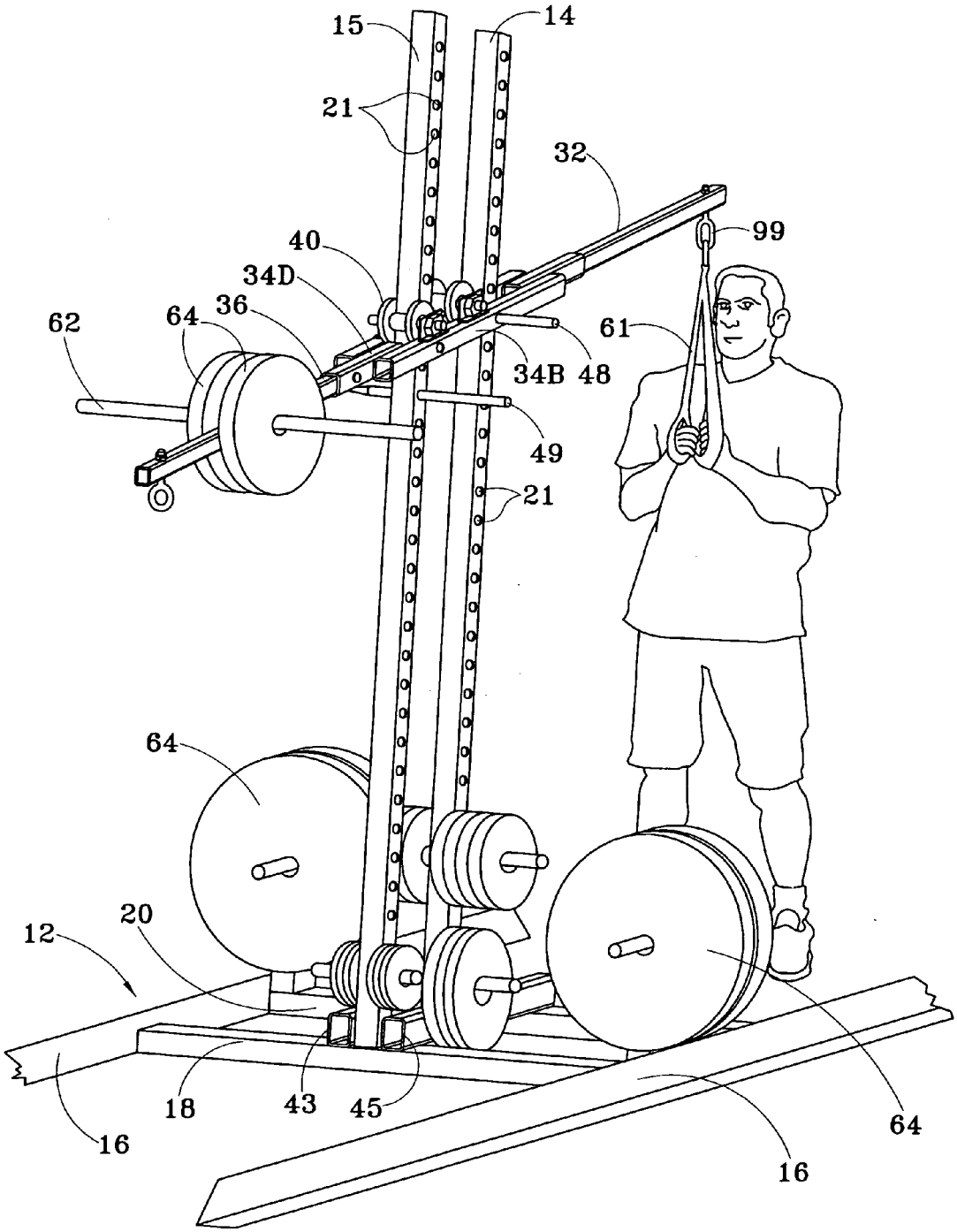
FIG. 4 is a frontal perspective view of the first embodiment of the device, showing a trainee engaged in triceps extensions using handgrips suspended by straps from a front beam attached to a front portion of the lever arm assembly of the device.

Referring particularly to FIGS. 2 and 3, in the first embodiment, the lever arm assembly 30 includes a dolly cage 34 that is mounted for vertical travel up and down the rear, pivoting stanchion 15. The dolly cage 34 includes a parallel pair of longitudinally-directed, laterally spaced-apart members 34A, 34B. The members 34A, 34B have rear ends joined by a rear spacer 34C and have front ends joined by a front spacer 34D. The rear and front spacers 34C, 34D, and the members 34A, 34B are preferably tubes rectangular in vertical cross-section. Intermediate the rear and front spacers 34C, 34D are a pair of rollers 40 mounted for rotation on axles 41 attached to members 34A, 34B. The rollers 40 are longitudinally spaced-apart sufficiently for the rear, pivoting stanchion 15 to be received between, and be engaged by, the rollers 40. A lever arm assembly pivot pin 48 inserts through laterally-directed apertures 50, 50' in the tubes 34A, 34B and through one of the apertures 21 in the fixed stanchion 14, whereby the lever arm assembly 30 is pivotally attached to the fixed stanchion 14. A safety spotter pin 49 inserts through an aperture 21 in the rear, pivoting stanchion 15 to support the lever arm assembly 30 from below.

Figure 14A:
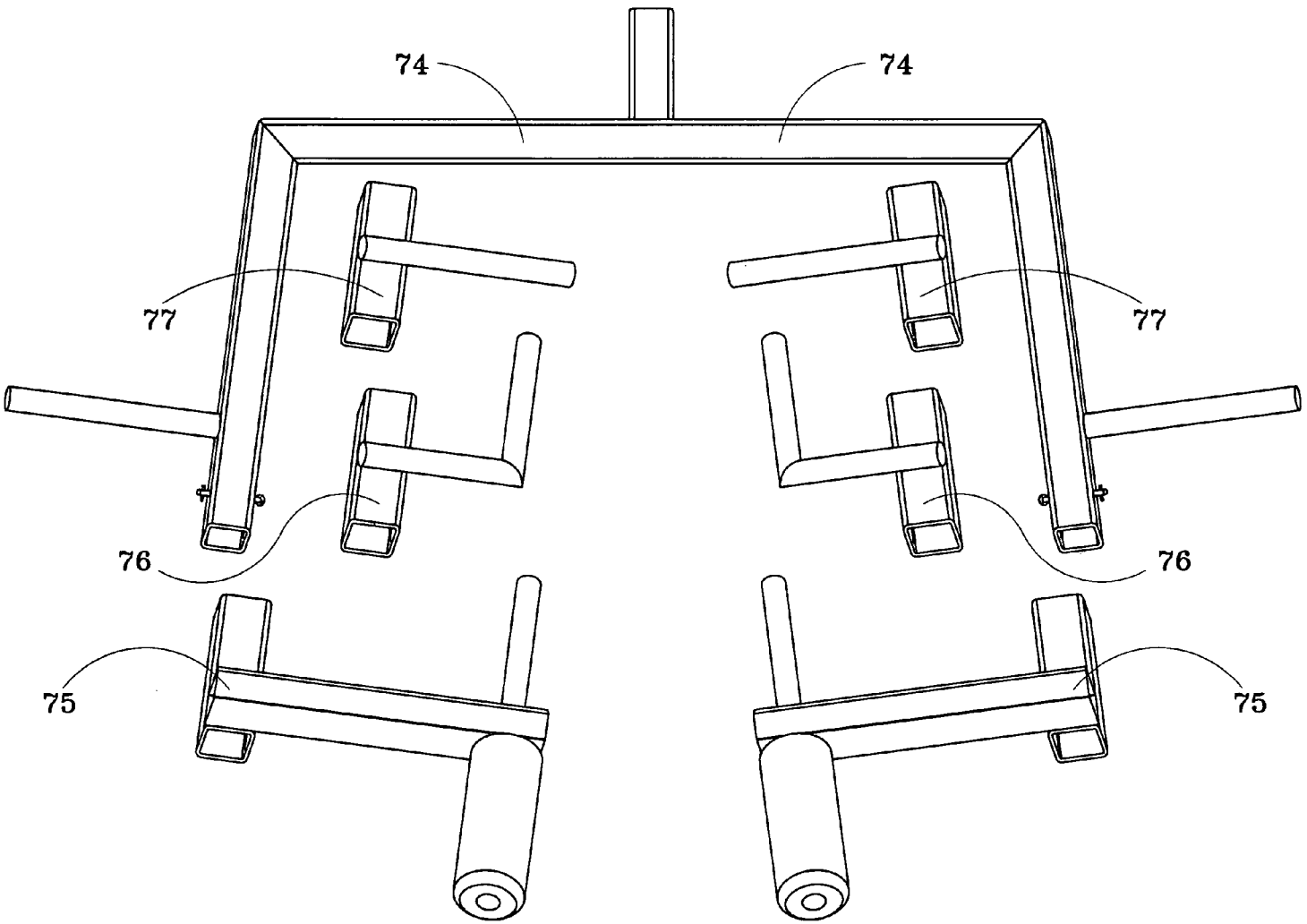
FIG. 14*a* is top perspective view of various kinds of body engaging means that may be used with the first embodiment of the device.

Means for suspending weights from the lever arm assembly 30 is provided, namely, a rear beam 36 that attaches to a rear end of the rear spacer 34C and extends rearward from the rear stanchion 15. The rear beam 36 has a second lateral bore (not shown) for attachment of a weight bar 62 upon which can be placed disc-shaped weights 64, as may best be seen in FIG. 4. Body engaging means is provided and includes a front beam 32 that attaches to a front end of the front spacer 34D and extends frontward from the front stanchion, and the lever arm assembly includes. The body engaging means further includes an I bolt 99 attached to a front portion of the front beam 32. A grip bar 60, as shows in FIGS. 1(*a*) and 1(*b*) or a pull strap 61 as illustrated in FIGS. 1(*c*) and 1(*d*) can be attached to the I bolt 99. FIG. 14A further depicts other body engaging means attachable to the first embodiment of the device 10, including a lifting arm 74, a pair of squat bars 75 that engage the shoulders during leg squats, a pair of dip bars 76 for performing dips, and a pair of press bars 77 that are used for performing bench presses.

Figure 5:
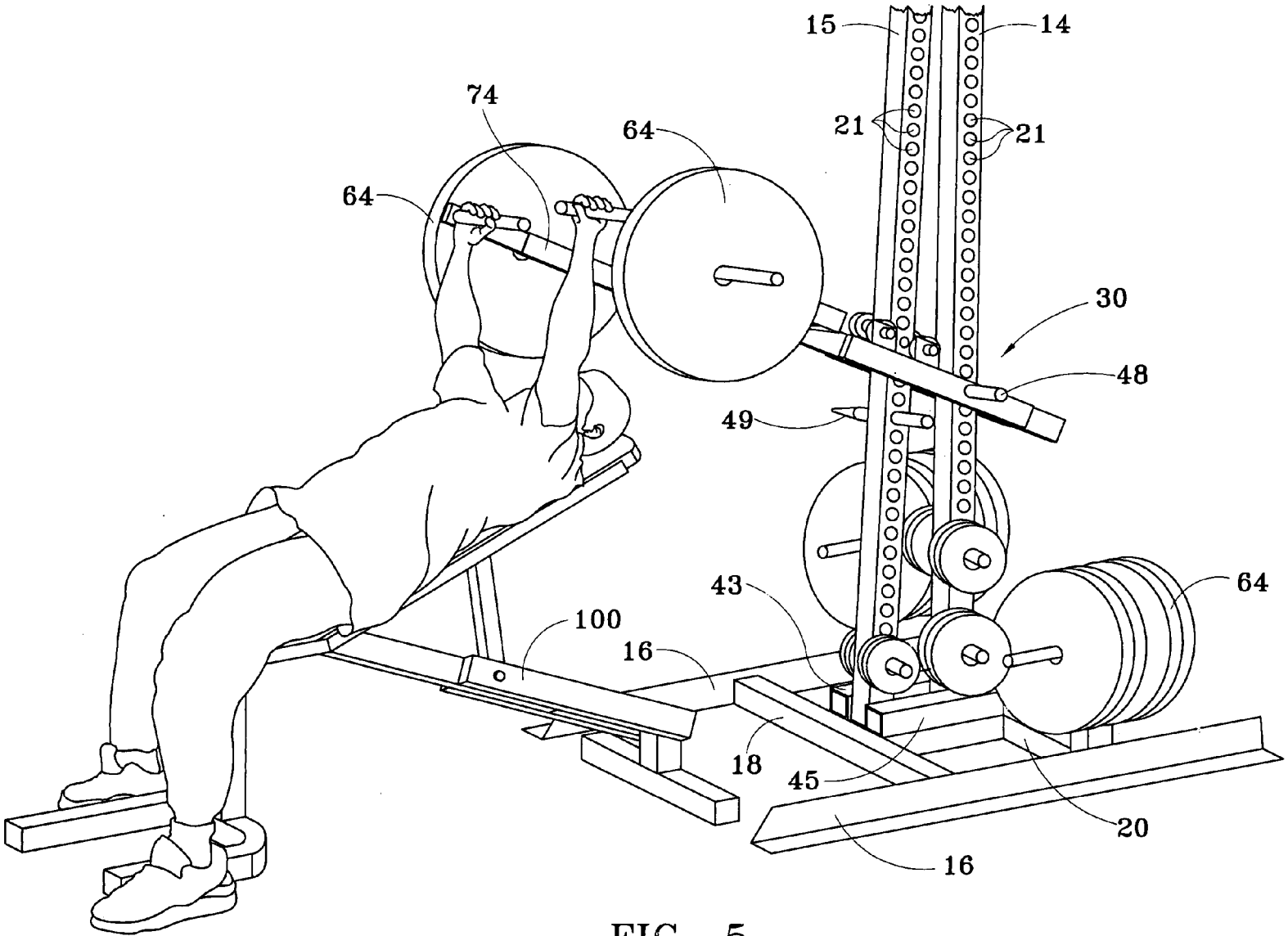
FIG. 5 is an enlarged, rear perspective view of the first embodiment of the device, showing a trainee performing bench presses at the rear of the device.
Figure 6:
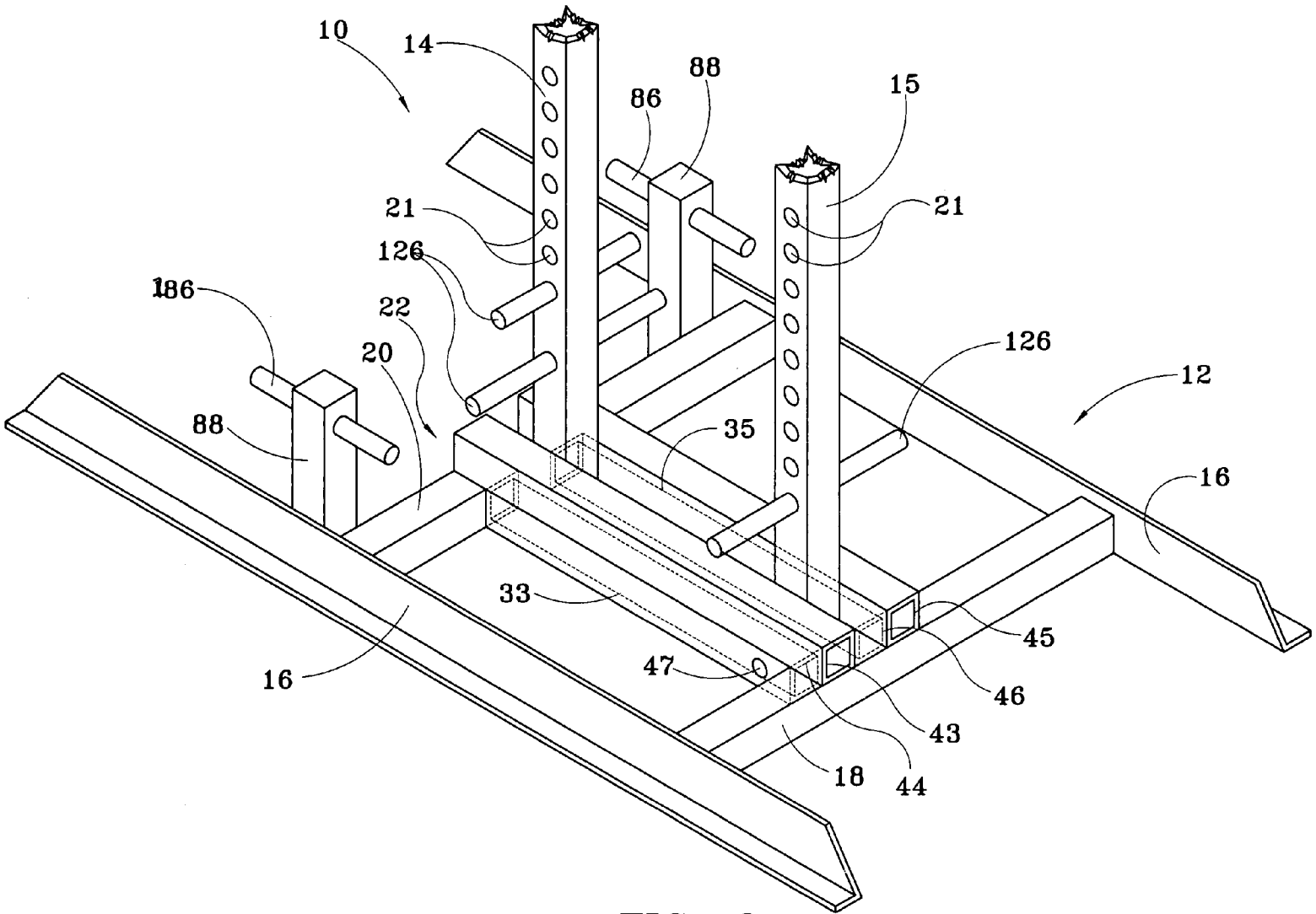
FIG. 6 is a rear perspective view of the base and lower portions of the front and rear stanchions of the first embodiment of the device.
Figure 8:
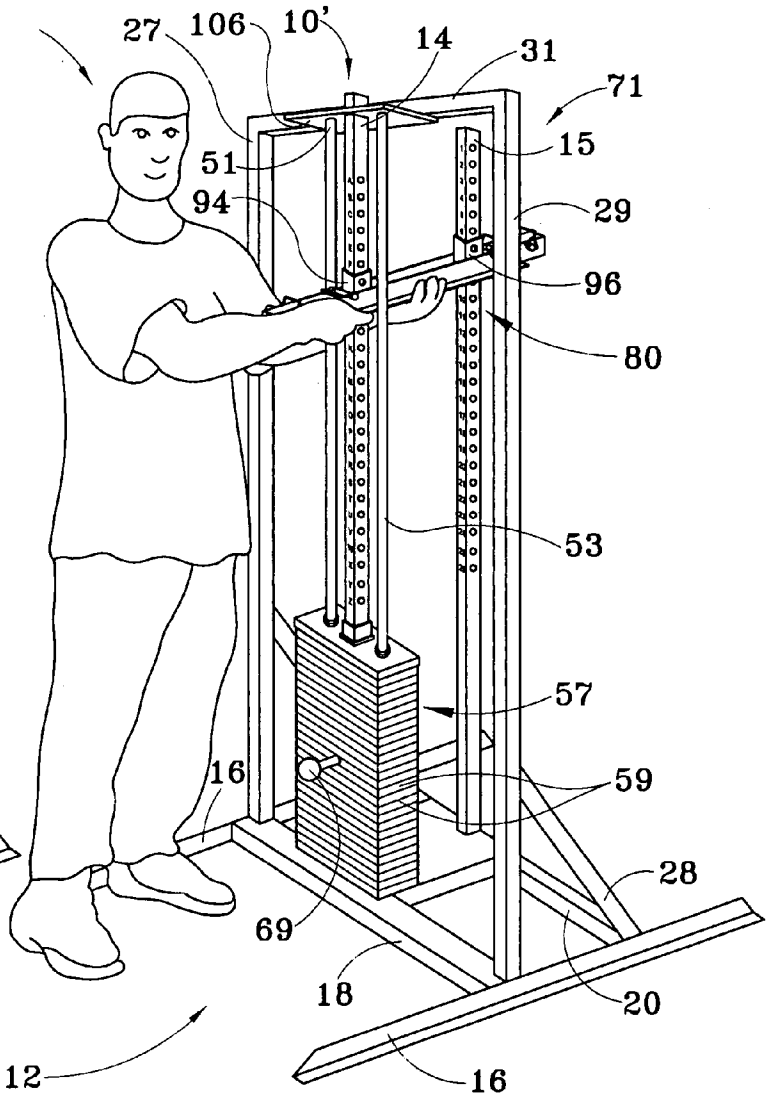
FIG. 8 is a frontal perspective thereof showing a trainee adjusting the lever arm assembly.
Figure 7:
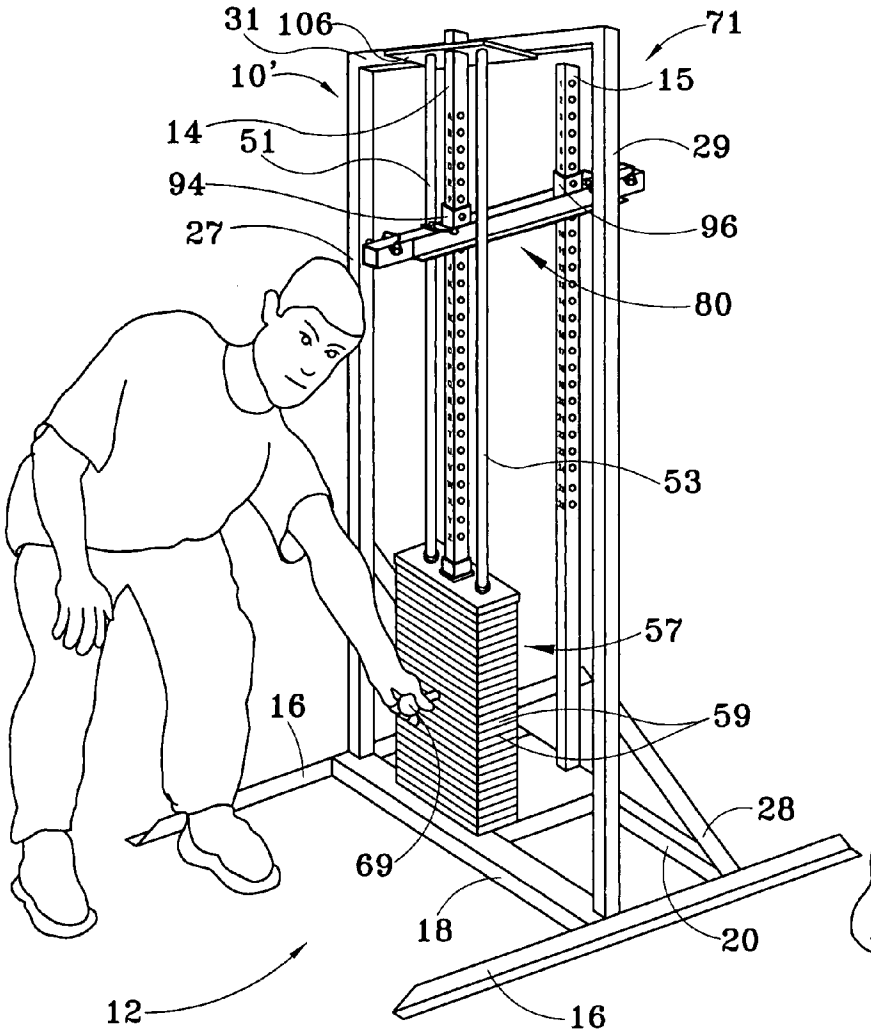
FIG. 7 is a frontal perspective view of a second embodiment of the device wherein a trainee is placing a stack pin through a plate within a weight stack thereof.

In use, a trainee places weights 64 in the amount and number desired onto the weight bar 62. Certain exercises are performable by the trainee while positioned at the front of the device, such as pulldowns and triceps extensions as depicted in FIGS. 1(*a*) and 1(*b*). Other exercises are performable by the trainee while positioned on a seat and back rest assembly 100 at the rear of the device 10, such as bench presses, by pressing upward on a lift arm 74 as depicted in FIG. 5. For each kind of weight lifting exercise, and for his/her particular body size and degree of conditioning, the trainee determines by trial and error an optimal aperture 21 on the front stanchion 14 to be used as a pivot point for the lever arm assembly 30 and inserts the lever arm assembly pivot pin 48 through the lateral bore in the front member and into said optimal aperture 21. The trainee also determines, for the desired range of motion for the exercise, an optimal aperture 21 on the rear, pivoting stanchion 15 and inserts the safety spotter pin 49 under a rear portion of the lever arm assembly 30 and into said aperture 21. As the trainee pulls the body engaging means (e.g., a pull strap 61) down while positioned at the front of the device 10, or while positioned at the rear of the device presses upward on a grip bar 74, to raise the weights 64, the lever arm assembly 30 pivots about the lever arm assembly pivot pin 48 and the dolly cage 34 rises, thereby causing the rear, pivoting stanchion 15 to pivot about the base 12 alternately toward and away from the trainee. This has the desirable effect of maintaining a substantially uniform resistance against the effort of the trainee through the range of motion of the exercise. Notice, for instance, how in FIG. 1(*c*) the second stanchion 15 has pivoted toward the fixed stanchion 14. Similarly, in FIG. 5, notice how the pivoting stanchion 15 has pivoted toward the fixed stanchion 14 when the trainee, lying on an inclined bench 72, has extended his arms upward during a bench press of weights 64 by manually applying an upward force to a pair of press bars 77 attached to the lift arm 74. As shown in FIG. 6, weight storage bars 126 extend laterally from the stanchions 14, 15 for storing weights 64; similarly, longitudinally-disposed weight storage bars 186 are supported by pillars 88 attached to the base 12. A variety of body engaging means can be used with this first embodiment, as depicted in FIG. 14A.

Figure 13:
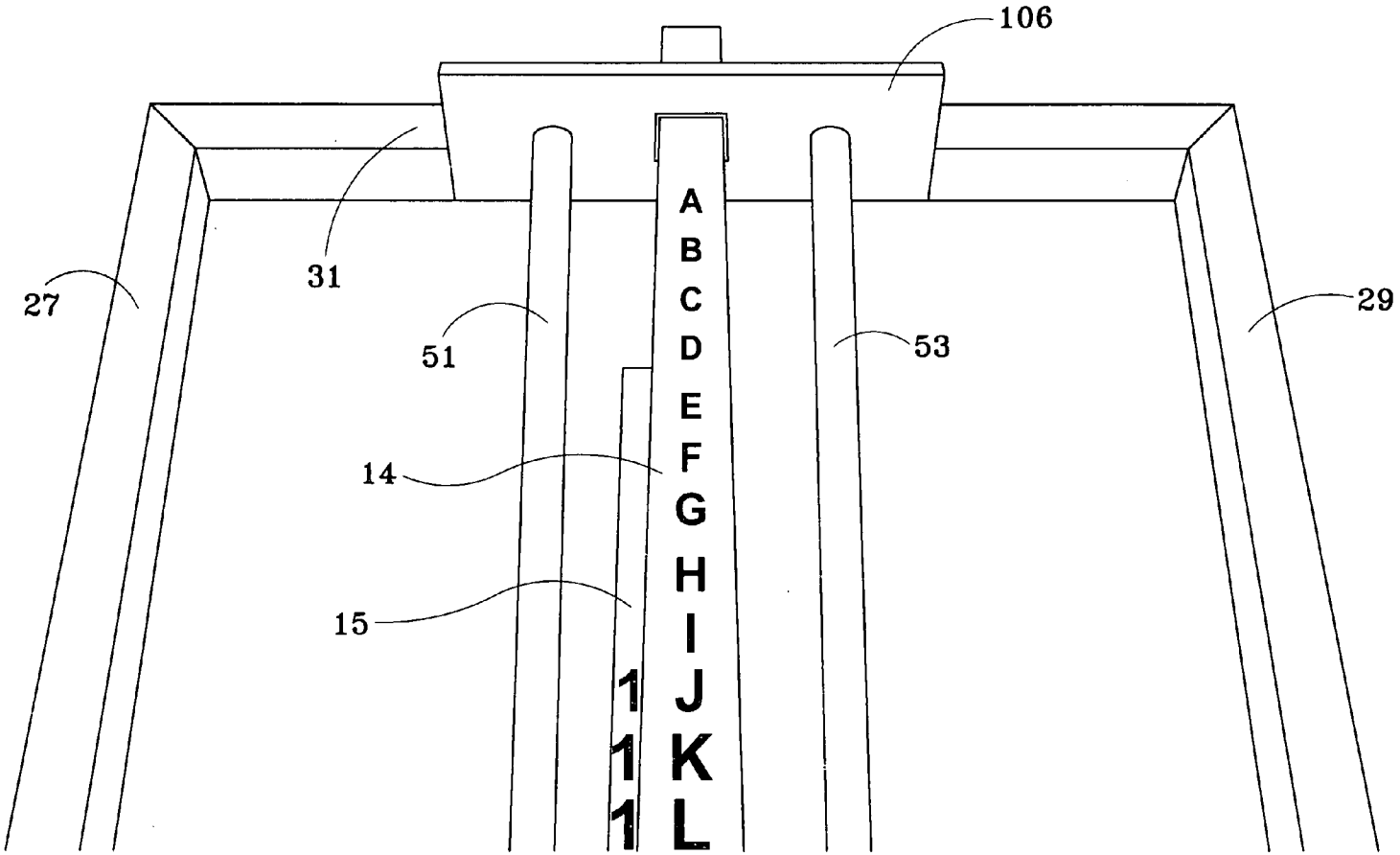
FIG. 13 is an enlarged, perspective view of an upper portion of the second embodiment of the device as seen from below.
Figure 23:
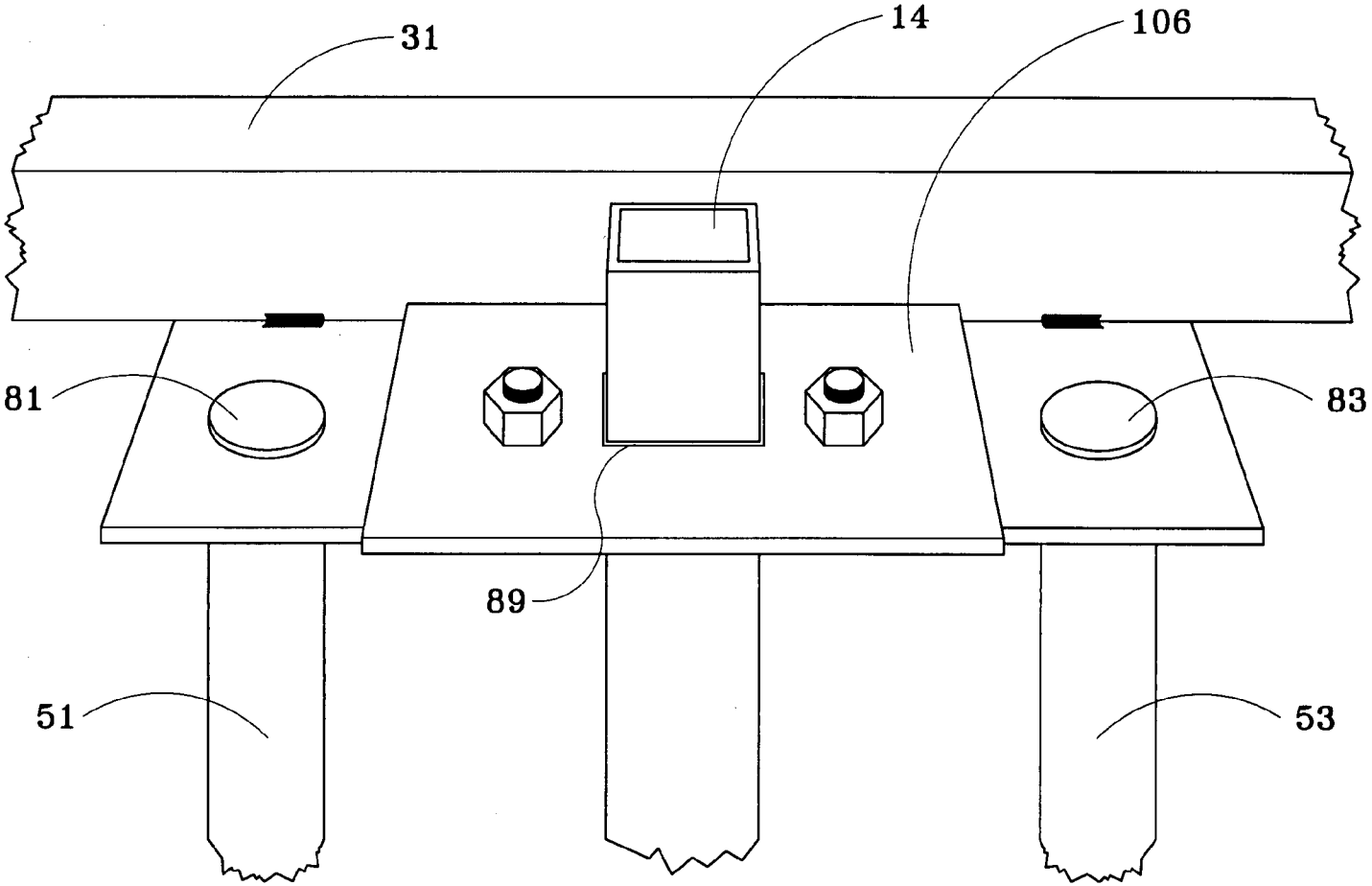
FIG. 23 is an enlarged, fragmentary, top perspective view of the second embodiment of the device.
Figure 25:
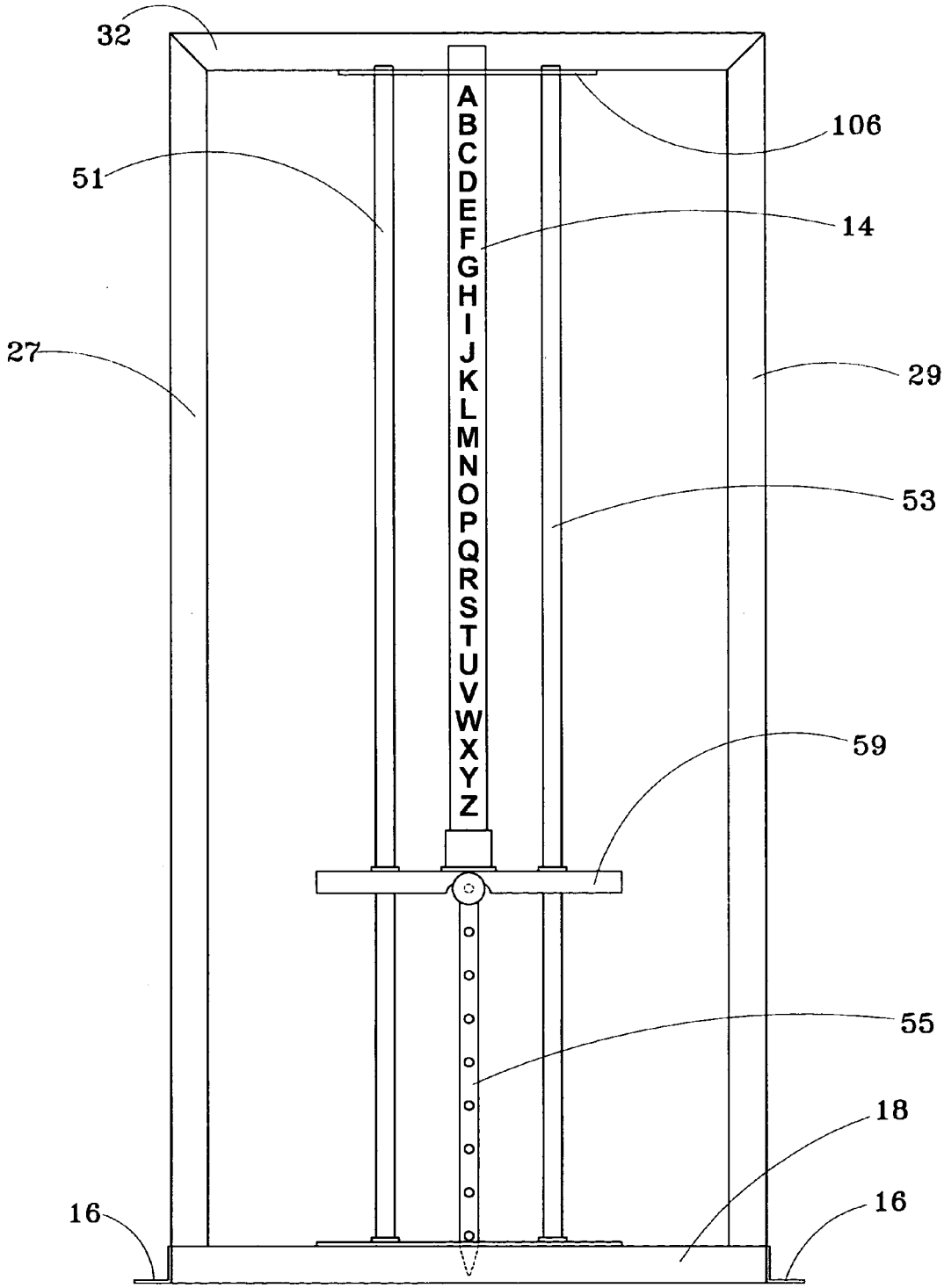
FIG. 25 is a frontal perspective view of the second embodiment of the device with the lever arm assembly and weight stack removed.

In a second, alternative embodiment, denoted by the numeral 10', my weight exercise device comprises a base 12 and an upstanding frame 71 attached to the base. The frame 71 includes a laterally-disposed cross bar 31 supported by and joined to upper ends of a pair of laterally spaced-apart, vertical support columns 27, 29. The base 12 includes a pair of longitudinally-directed, laterally spaced-apart angle irons 16 joined by a parallel pair of laterally directed, spaced-apart, cross beams 18, 20 of equal length. Lower ends of columns 27, 29 are attached to opposite sides of cross beam 18, and an angled pair of support struts 28 extends from the angle irons 16 to lower portions of the columns 27, 29. The device 10' further comprises a pair of laterally spaced-apart guide rods 51, 53 and a stack pin rod 55 intermediate the guide rods 51, 53. The rods 51, 53 extend upward from the cross beam 18 to the cross bar 31. As may best be seen in FIG. 25, the stack pin rod 55 extends downward from a front, vertically-movable stanchion 14 and has a free lower end. The stack pin rod 55 has a plurality of vertically spaced-apart apertures 21. As shown in FIGS. 13 and 23, a horizontal header plate 106 extends forward from the cross bar 31 and has a centrally-disposed opening 89 for receiving an upper end portion of the front stanchion 14, and openings 81, 83 on opposite sides thereof to receive upper end portions of the rods 51, 53, respectively.

A rear, pivoting stanchion 15 is disposed rearward from and coplanar with the front stanchion 14. The base 12 further includes a parallel pair of longitudinally-directed angle irons 103, 105 that extend between the cross beams 18, 20, as may be seen in FIG. 9. A lower end portion of the rear stanchion 15 is disposed between the angle irons 103, 105 and is pivotally attached to the base 12 by pivot pin 47 laterally inserted through aligned apertures (not shown) in said lower end of the stanchion 15 and through apertures (not shown) in the angle irons 103, 105. The stanchion 14 and the pivoting stanchion 15 each have a plurality of vertically spaced-apart, laterally-directed apertures 21; said apertures 21 on each of the stanchions 14, 15 are sequentially labeled from the top ends to bottom ends thereof by indicia, which are preferably alphabetic indicia 23 and numerical indicia 25, respectively.

Figure 16:
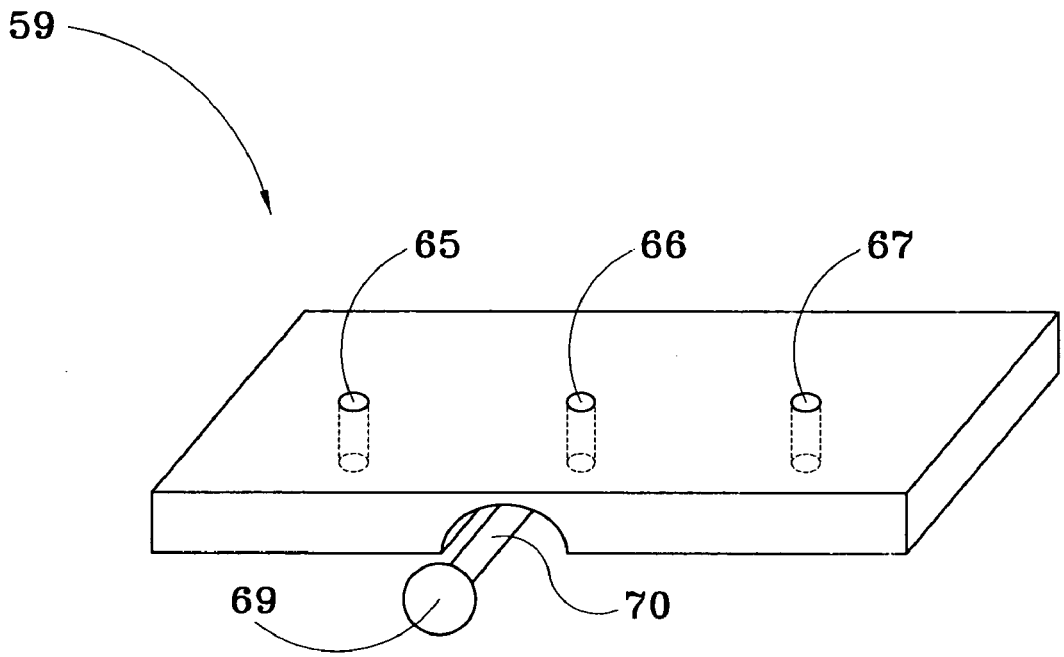
FIG. 16 is an enlarged, frontal perspective view of a weight plate and stack pin of the second embodiment of the device.
Figure 17:
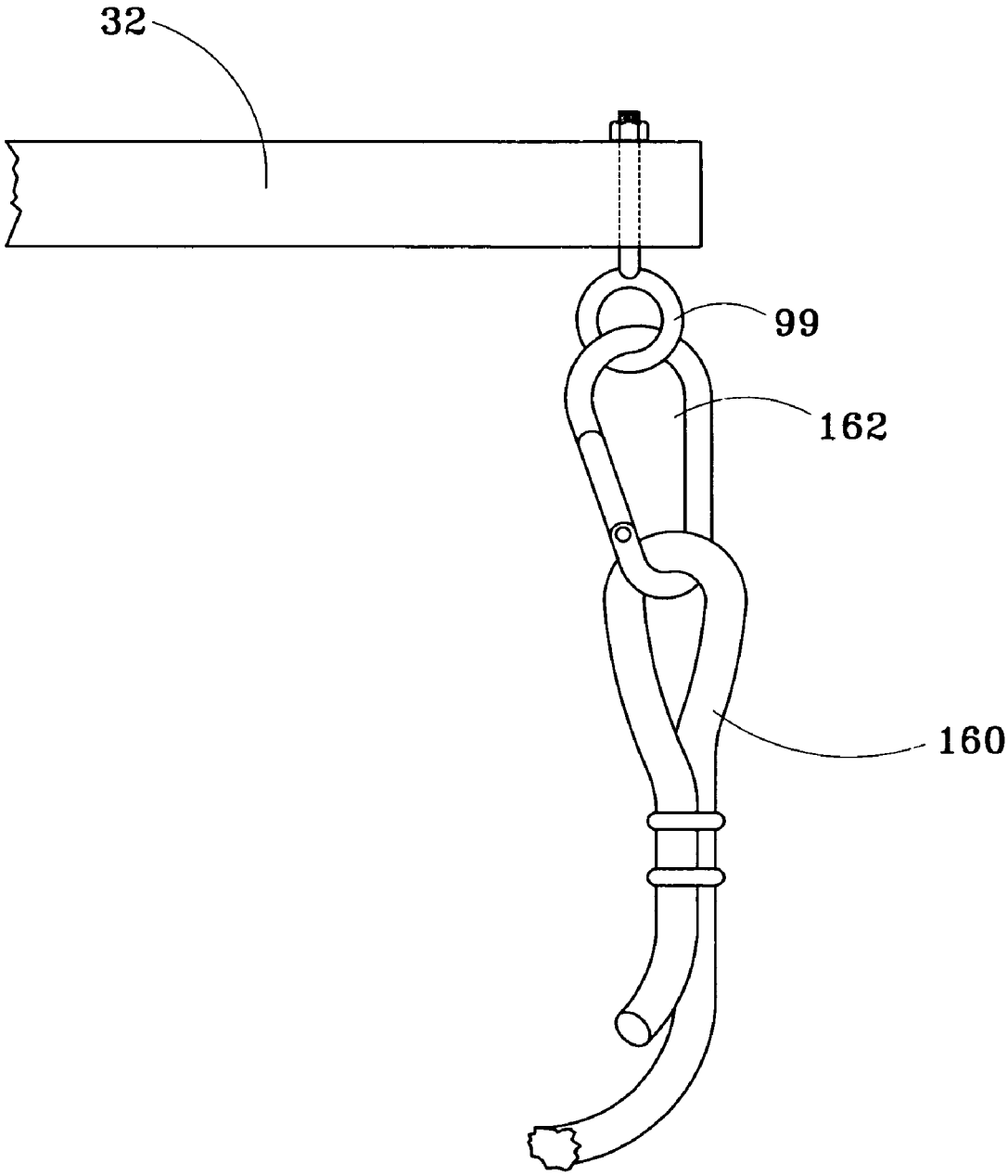
FIG. 17 is an enlarged, fragmentary, side elevational view of the distal end of a cable connected by a quick release clip to an I-bolt attached to a rear portion of the rear beam thereof.
Figure 18:
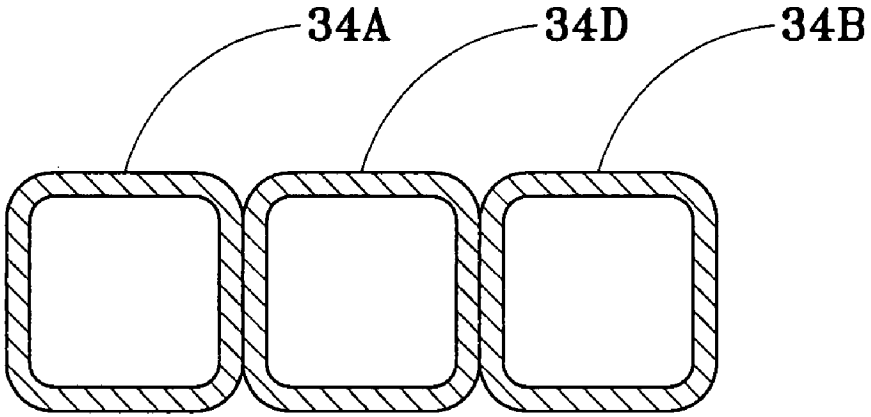
FIG. 18 is a vertical cross-sectional view taken along the line 18—18 of FIG. 2.
Figure 19:
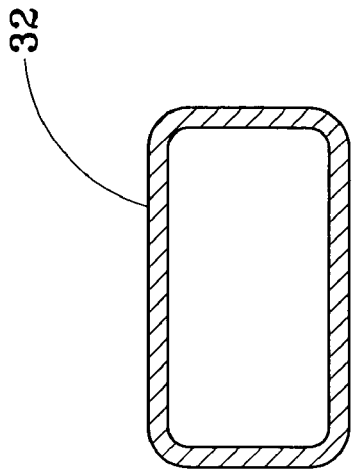
FIG. 19 is an enlarged, vertical cross-sectional view of the front beam depicted in FIG. 4.
Figure 20:
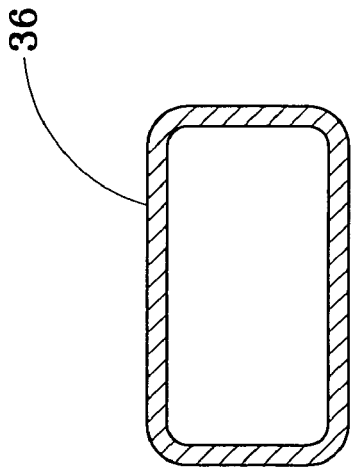
FIG. 20 is an enlarged, vertical cross-sectional view of the rear beam depicted in FIG. 4.
Figure 21:
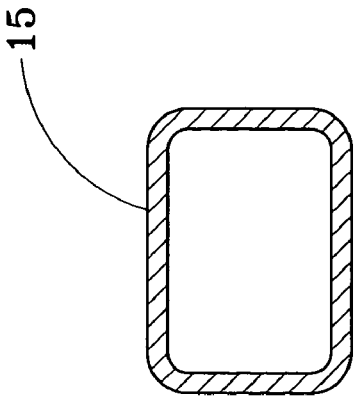
FIG. 21 is an enlarged, horizontal cross-sectional view of the rear stanchion depicted in FIG. 4.
Figure 22:
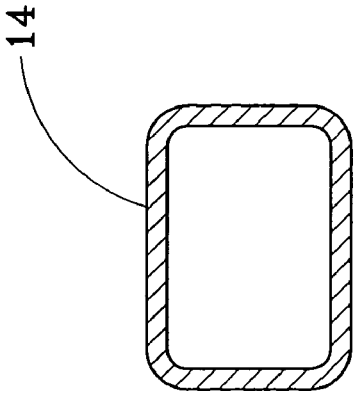
FIG. 22 is an enlarged, horizontal cross-sectional view of the front stanchion depicted in FIG. 4.

A weight stack 57 is mounted on the guide rods 51, 53, and the stack pin rod 55 and is vertically slidable thereon. The weight stack 57 is comprised of a plurality of weight plates 59 in vertical, stacked relation such that the upper weights of the stack rest upon the lower weights of the stack. As may be seen in FIG. 16, each plate 59 has a pair of laterally spaced-apart openings 65, 67 and a central opening 66 for permitting each plate 59 to slide along the guide rods 51, 53 and the stack pin rod 55, respectively. Each plate 59 also has a longitudinally-directed aperture or cutout 70 adapted to receive a stack pin 69, such that insertion of the stack pin 69 through a selected plate 59 and through an aligned aperture 21 of the stack pin rod 55 attaches said plate 59, and all weight plates that rest thereon, to the first stanchion 14.

Figure 10A:
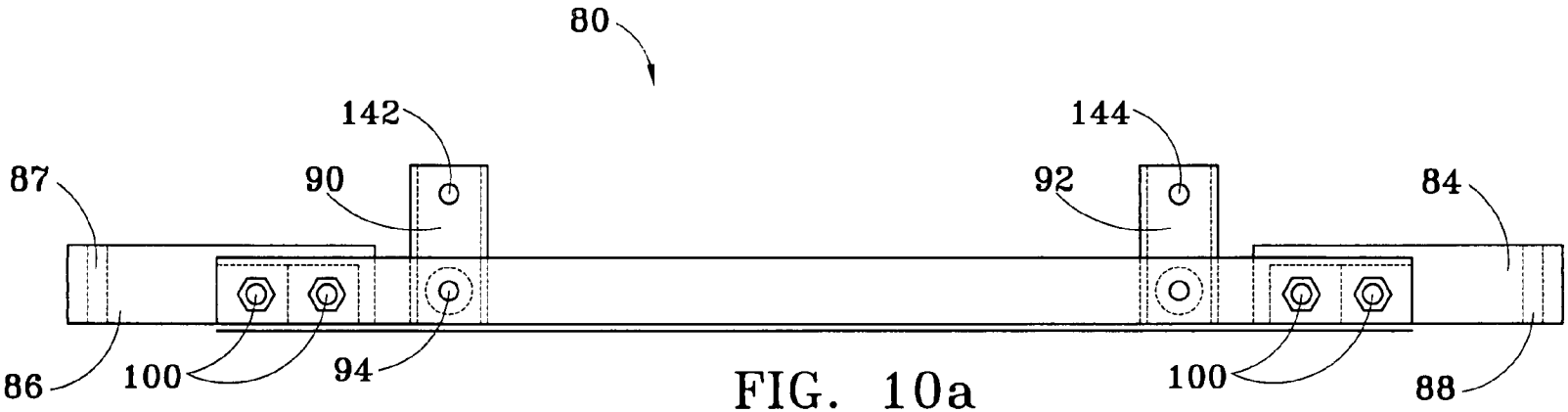
FIG. 10(*a*) is a side elevational view and FIG. 10B is a top plan view of the lever arm assembly thereof.
Figure 10B:
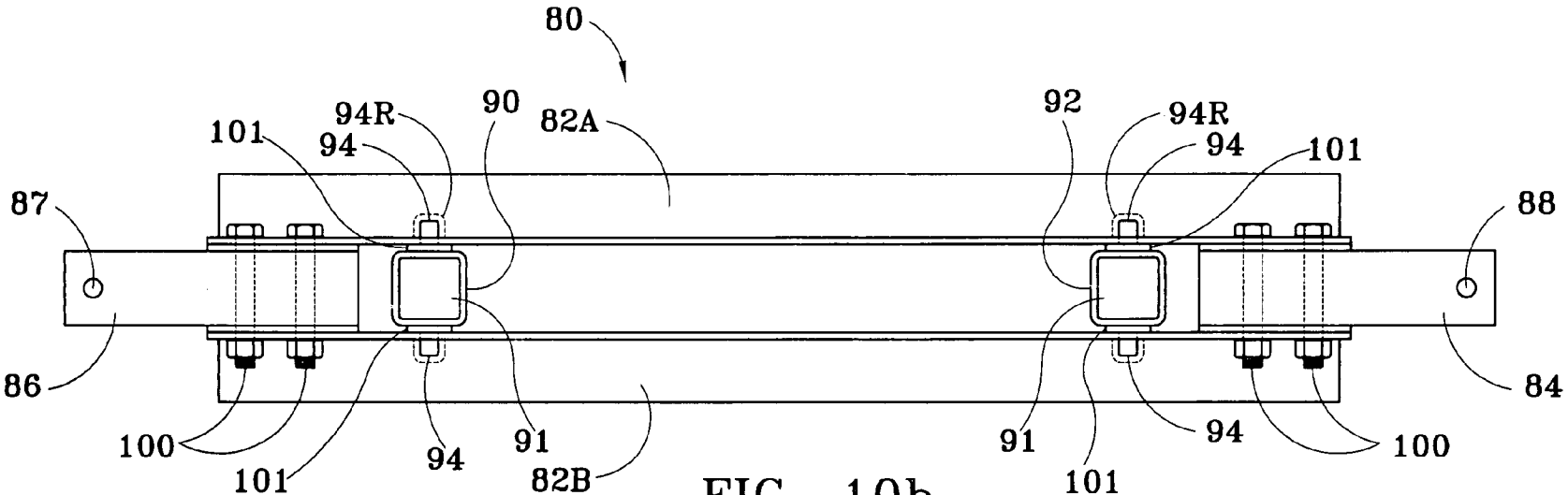
Figure 11B:
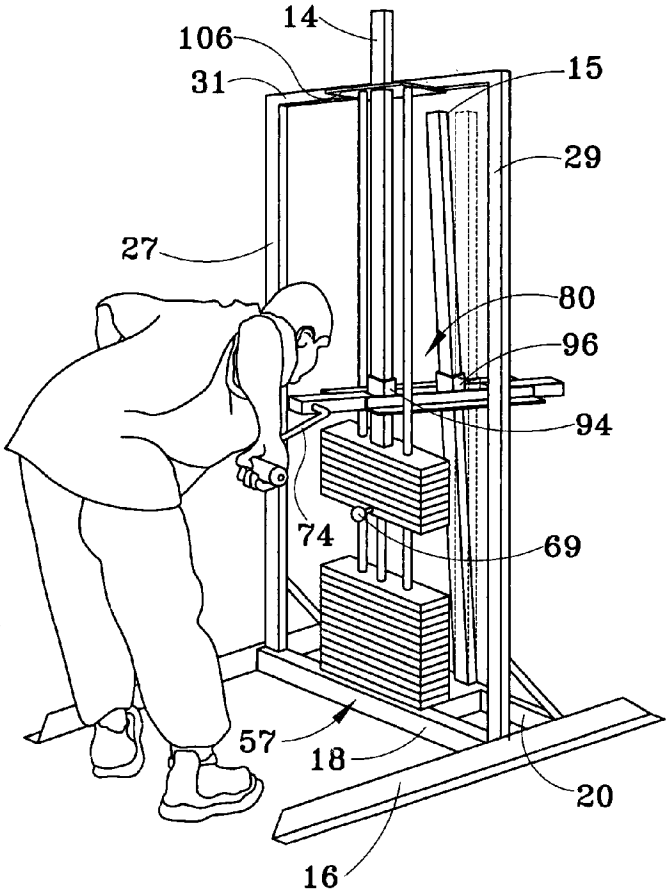
FIGS. 11(*a*) and (*b*) are frontal perspective views of a trainee performing bent over rows at the front of the second embodiment of the device.
Figure 11A:
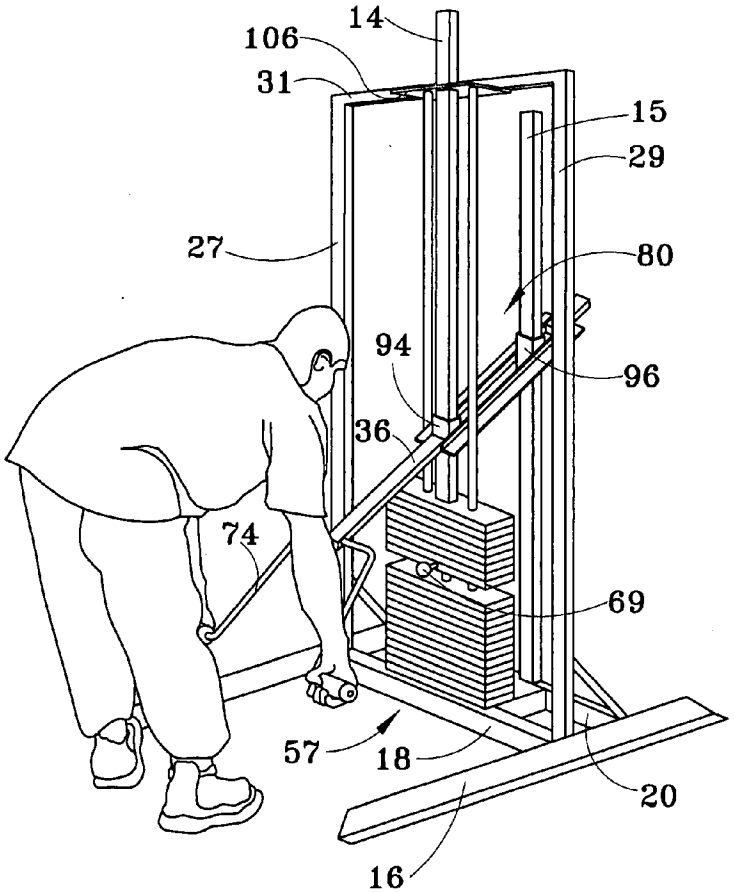
Figure 15:
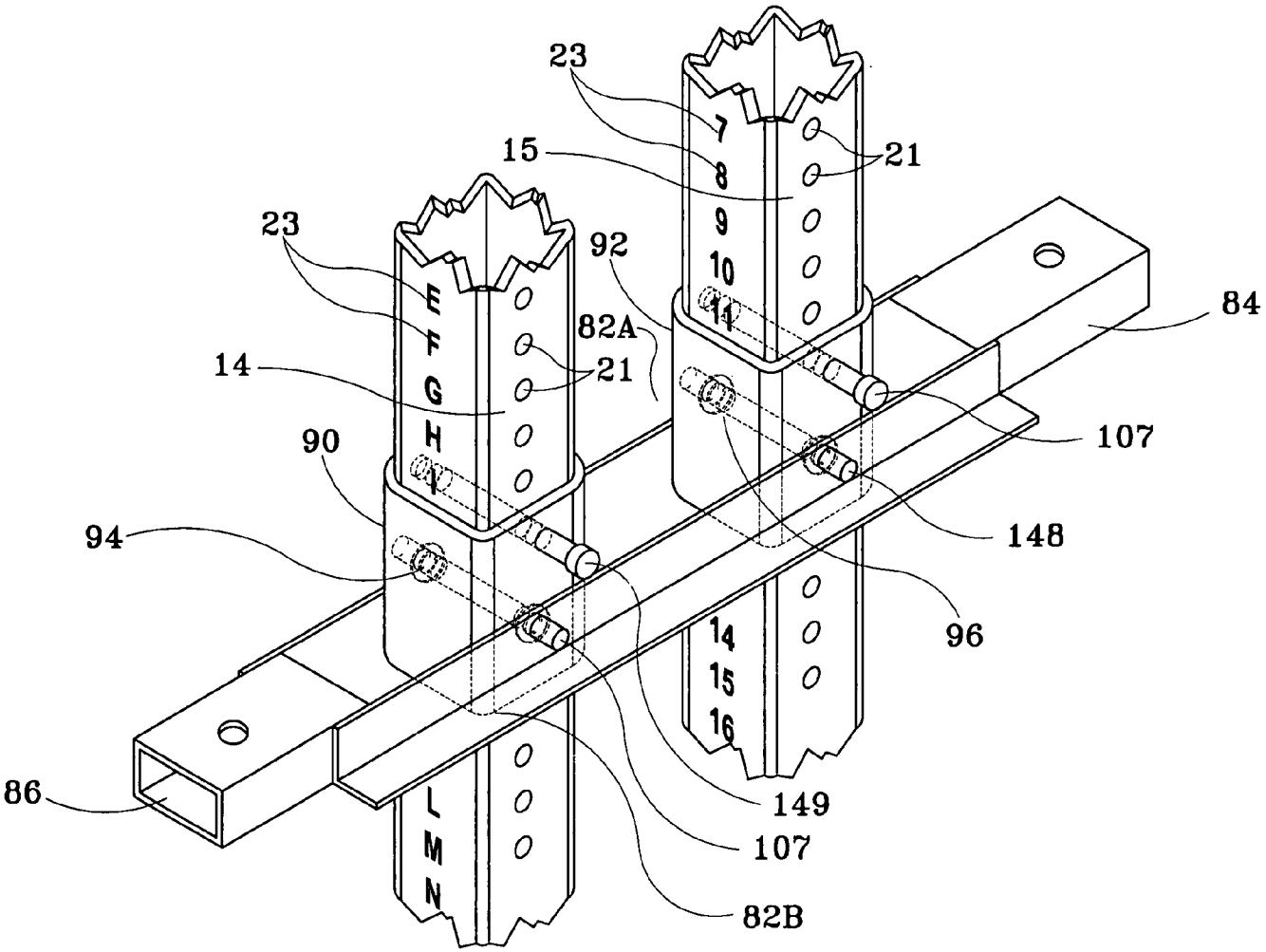
FIG. 15 is an enlarged, frontal perspective view of the lever arm assembly of the second embodiment of the device, showing pivotal connections of said assembly to the front and rear stanchions (the stanchions are shown in fragmentary, perspective view).

With reference now to FIGS. 10A, 10B and 15, the second embodiment 10' further comprises a lever arm assembly 80 having a parallel pair of laterally spaced-apart longitudinal members 82A, 82B joined at a rear end thereof by a rear member 84 that extends rearward of the members 82A, 82B, and joined at a front end thereof by a front member 86 that extends frontward of the members 82A, 82B. The longitudinal members 82A, 82B are preferably angle irons. As may be seen in FIGS. 10A, 10B, the rear and front members 84, 86 are attached to the longitudinal members 82A, 82B by bolts 100 as well as by welds. Means are provided to pivotally attach the lever arm assembly 80 to the front stanchion as well as to the rear stanchion. Said means include an upstanding front collar 90 disposed between the longitudinal members 82A, 82B and rear-adjacent to the front member 84, and an upstanding rear collar 92 disposed between the longitudinal members 82A, 82B and front-adjacent to the rear member 84. Each collar 90, 92 defines an opening 91 adapted to surround, and to vertically slide up and down upon, the stanchion 14, 15, respectively, that is inserted through said opening 91; that is, the front collar 90 slides up and down the front stanchion 14 and the rear collar 90 slides up and down the rear stanchion 15. A pair of laterally-disposed, oppositely-directed studs 94 project out from each of the collars 90, 92 and are received in apertures or recesses 94R in the members 82A, 82B, whereby each of the collars 90, 92 can pivot in a vertical plane about said studs 94. The front collar 90 has a laterally-directed aperture 144 through which is inserted a front pivot pin 149 for pivotally attaching a front end portion of the lever arm assembly 80 at a selected height on the front stanchion 14 by further extending the front pivot pin 149 into a selected aperture 21. Similarly, the rear collar 92 has a laterally-directed aperture 144 through which is inserted a rear pivot pin 150 for pivotally attaching a rear end portion of the lever arm assembly 80 at a selected height on the rear stanchion 15 by extending the rear pivot pin 150 into a selected aperture 21 thereon. Depending on the particular type of exercise that is to be performed as well as upon the size and physical condition of a trainee, a weight trainer can specify a recommended placement of the lever arm assembly 80 on the front and rear stanchions 14, 15 by specifying a letter followed by a numeral. For example, such a specification might be E for the pivotal connection to the front stanchion and 5 for the pivotal connection to the rear stanchion. Or, by trying various combinations, a trainee can determine which pair of pivot combinations is most suitable for him/her for each exercise selected from a variety of weight lifting exercises that are performable using the device 10'—e.g., pulldowns, triceps extensions, bench presses, and so forth.

Figure 14B:
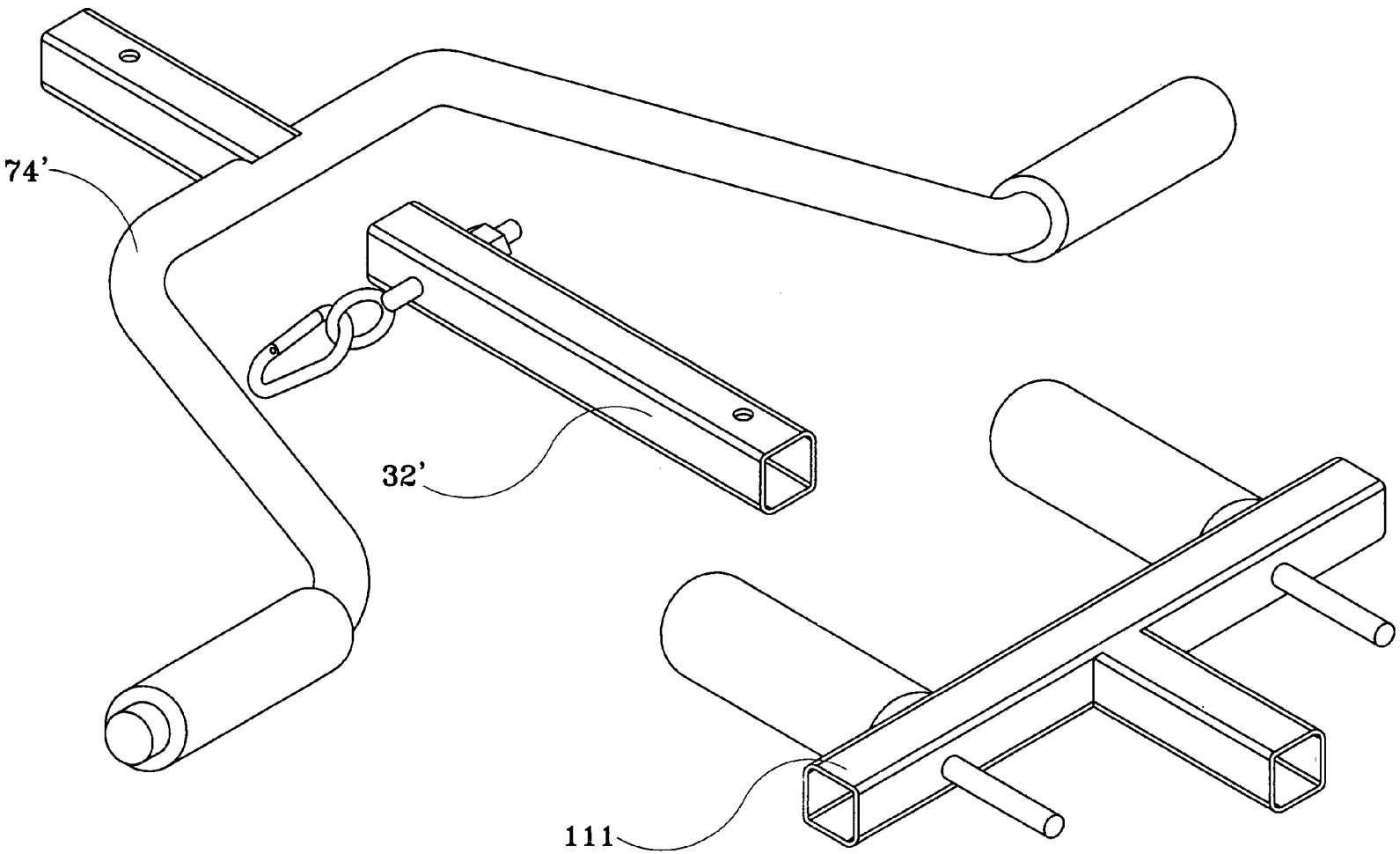
FIG. 14*b* is a top perspective view of various kinds of body engaging means that may be used with the second embodiment of the device.

Body engaging means for the second embodiment of the device 10' are illustrated in FIG. 14B, and include a lift arm 74', a front beam 32' that carries an I bolt and that can also be used as a rear beam, and a padded pair of shoulder bars 111. To facilitate attachment of body-engaging means to the device 10', the rear and front members 84, 86 of the lever arm assembly 80 each have a rectangular opening. The lift arm 74' has a shank portion 74S' fashioned from square tubing and adapted for attachment to the front member 86 or rear member 84. Similarly, the padded pair of shoulder bars 111 has a shank portion 111S fashioned from square tubing and adapted for attachment to the front member 86 and to the rear member 84. Weight engaging means may be suspended from the front beam 32' by a quick release clip 162 that attaches to the I bolt 99.

To use the second embodiment of the device 10', the trainee attaches a front beam 32' to the front end of the lever arm assembly 80 or a rear beam 36 to the rear end of the lever arm assembly 80 and then attaches the appropriate body engaging means to either the front beam 32' or the rear beam 36, depending upon which exercise is to be performed (see FIGS. 11, 12*a*, 12*b*, 12*c*, 12*d*, 12*e* for examples). Next, the trainee places the stack pin 69 through a selected weight 59—the lower the location of the pin 69 within the weight stack 57 the more weight there will be attached to the front stanchion 14 to be lifted. The lever arm assembly 80 is pivotally attached to the front and rear stanchions 14, 15 at pivot locations thereon suitable for that trainee and for the exercise that is to be performed, in the manner described above. The trainee then undergoes the desired number of repetitions of the selected exercise, and then repositions the lever arm assembly 80 for the next exercise.

Figure 12A:
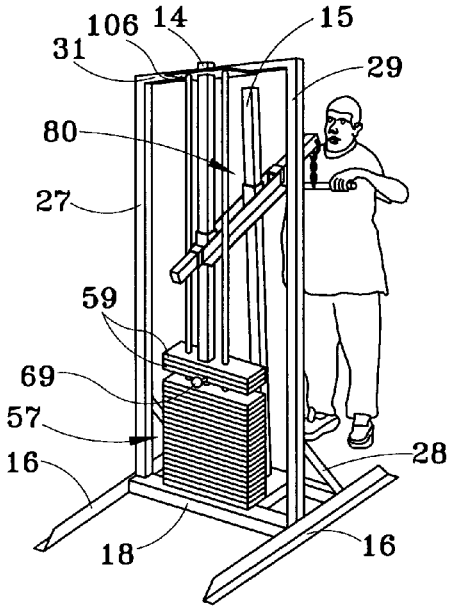
FIGS. 12*a* and 12*b* are frontal perspective views of a trainee performing push downs while standing at the rear of the second embodiment of the device.
Figure 12B:
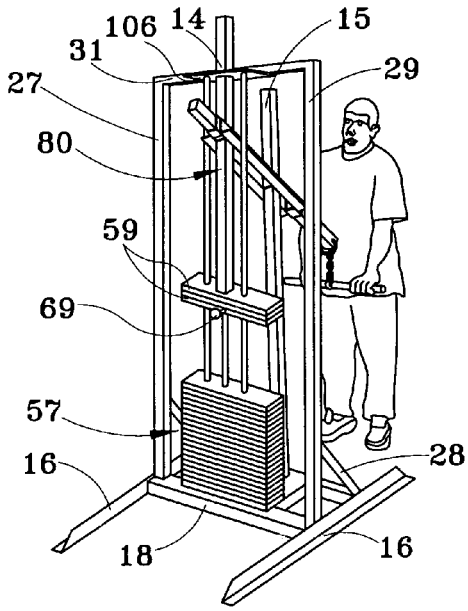
Figure 12C:
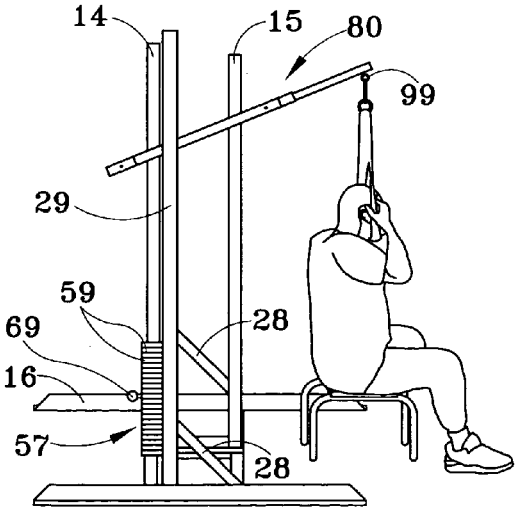
FIGS. 12*c* and 12*d* are side perspective views of a trainee performing a crunch while seated on a bench on the rear side of the second embodiment of the device.
Figure 12D:
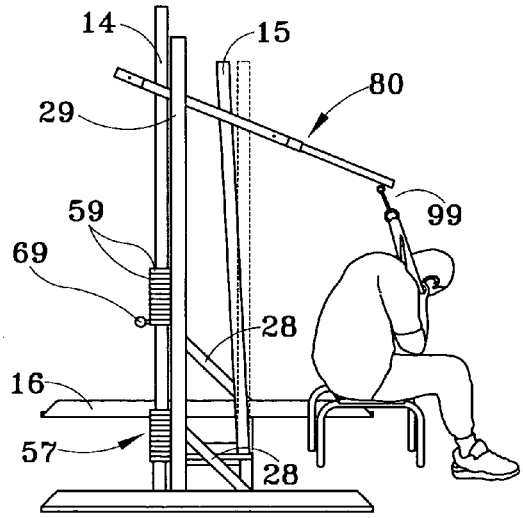
Figure 12F:
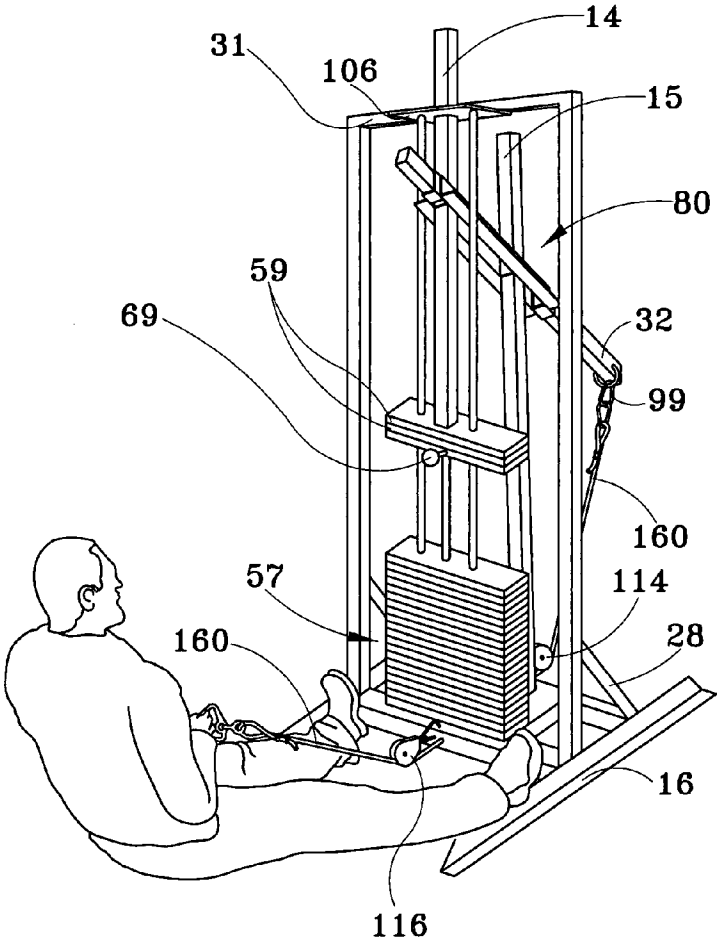
FIGS. 12*e* and 12*f* are frontal perspective views of a trainee performing seated or low cable rows at the front of the second embodiment of the device.
Figure 12E:
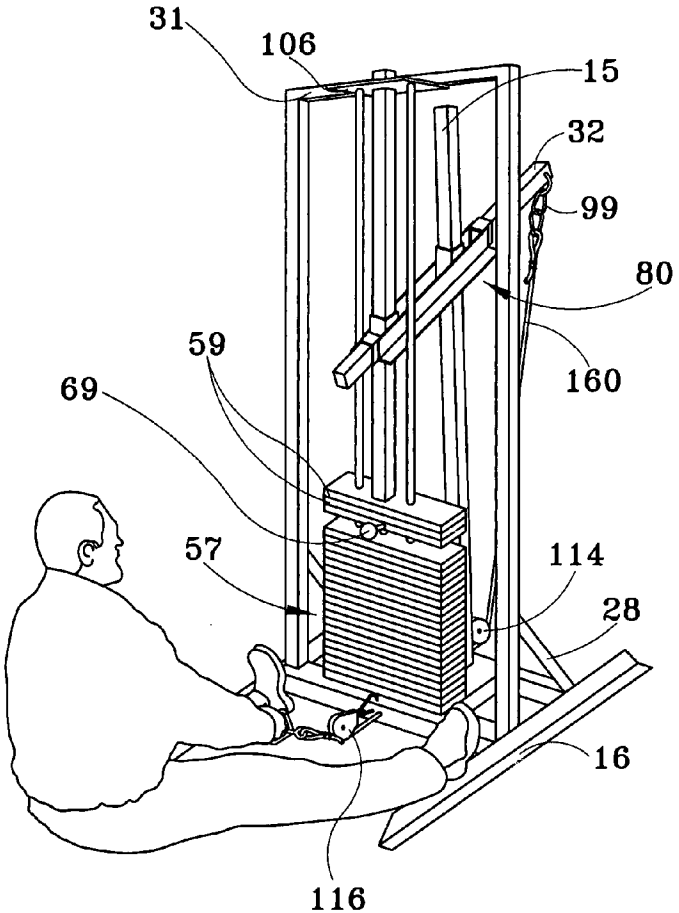
Figure 24:
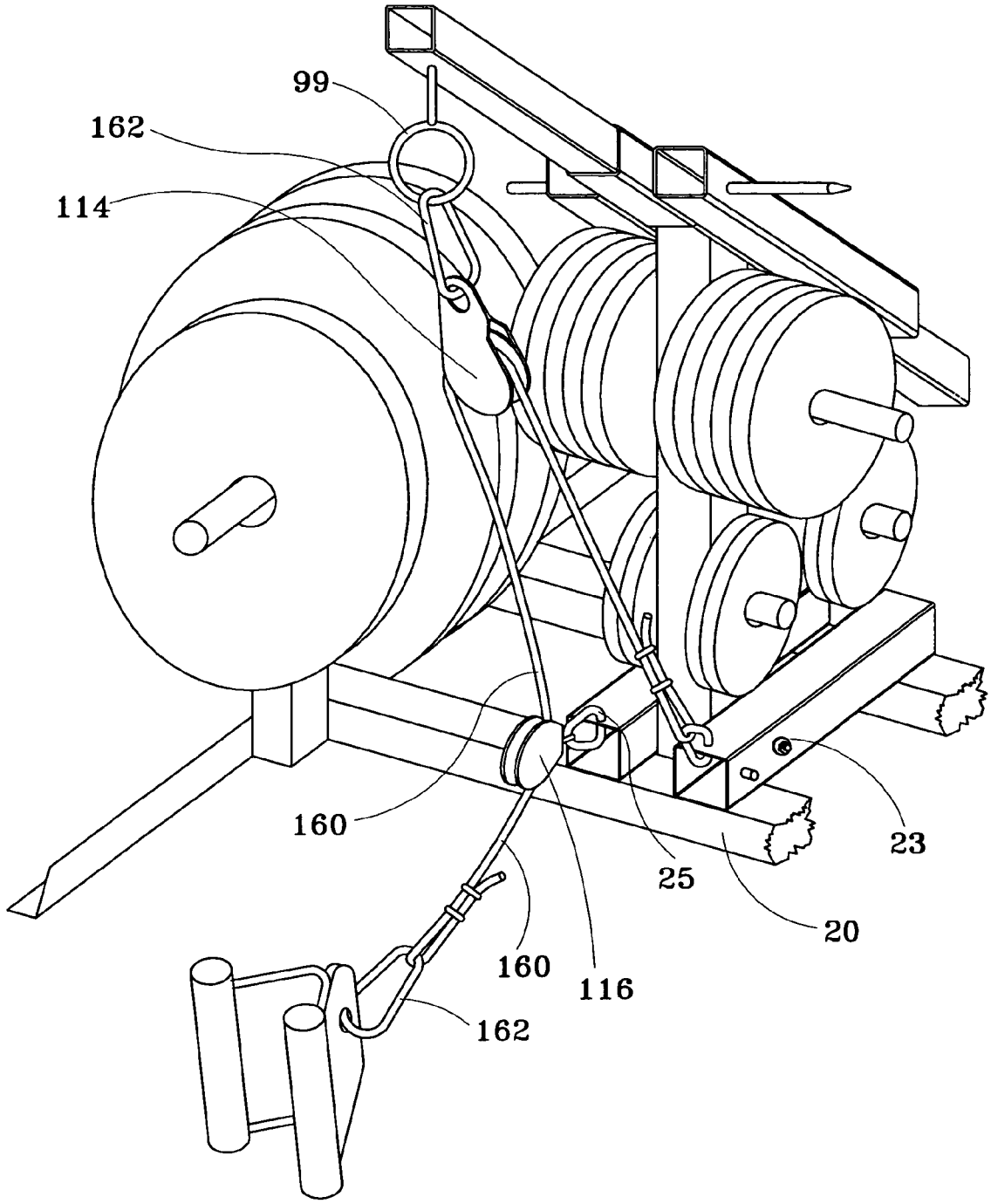
FIG. 24 is an enlarged, fragmentary, front perspective view of the first embodiment of the device showing a cable-and-pulley arrangement attached to a front portion thereof.

Additional kinds of exercises, such as seated or low pulley rows as depicted in FIGS. 12*e* and 12*f*, are performable with the second embodiment of the device 10' by connecting a first end of a cable 160 by a quick release clip 162 to the I bolt 99, routing the cable 160 rearward through a first pulley 114 attached to a rear portion of the base and through a second pulley 116 attached to rear portion of the base. The trainee, seated to the front of the device 10, 10', manually grasps and alternately moves backward and forward the hand grips 162 attached to a second, opposite end of the cable 160. Similarly, a cable-and-pulley arrangement for the first embodiment of the device 10 is possible for performing those and similar exercises, as illustrated in FIG. 24. In the case of the first embodiment, however, the cable 160 preferably is not routed under the base 12; instead, the cable 160 is routed from the front eye bolt 99 through two pulleys 114, 116 attached to a front portion of the device 10 and the trainee positions himself/herself to the front of the device 10 to perform exercises with the cable-and-pulley arrangement.

The standard weight lifting exercises that are performable with both embodiments of the device 10, 10' are listed below:

For exercising the back: deadlift, pull-down, bent-over rows, straight arm pull-downs.

For exercising the chest: flat bench press, inclined bench press, declined bench press, dips, assisted dips.

For exercising the legs: squats, leg press, stiff leg dead lift, lunges.

For exercising the calves: standing, sitting, leg press style.

For exercising the shoulders: seated shoulder press, standing press, upright rows, shrugs, straight arm raises.

For exercising the biceps: standing curls, one arm curls, concentration curls, incline curls.

For exercising the triceps: front triceps extensions, behind back extensions, incline extension, triceps kickbacks, one arm triceps extension.

For exercising the abdominals: knee ups, seated crunch, kneeling crunch, low pulley crunch, low pulley side bends.

For exercising the forearms: wrist curls, reverse wrist curls, hammer curls.

Various changes and modifications will become obvious to those skilled in the art. For example, the front and rear stanchions 14, 15 are described and depicted as tubes that are rectangular in vertical cross-section, but they could be solid and/or have vertical cross-sections that are circular or oval, et cetera. Similarly, the front and rear members of the lever arm assembly 80 of the second embodiment are depicted as rectangular tubes in vertical cross-section, but other geometric configurations are possible in ways that are well known to persons of ordinary skill in the art. It is the intent that these changes and modifications are to be encompassed within the spirit of the appended claims and that the invention described herein and shown in the accompanying drawings is illustrative only and not intended to limit the scope of the invention.

I claim:

1. A weight exercise device comprising:

a base having a front end portion and a longitudinally-opposite rear end portion;

a front, upstanding stanchion having a lower end attached to the front end portion of the base, said stanchion having a first set of vertically spaced-apart, laterally-directed apertures;

a rear, pivoting stanchion spaced rearward from the front stanchion and having a lower end pivotally attached to a rear end portion of the base for movement co-planar with the front stanchion and an upper free end, said pivoting stanchion having a second set of vertically spaced-apart, laterally-directed apertures;

a laterally-directed lever arm assembly pivot pin;

a lever arm assembly longitudinally disposed and coplanar with the front and rear stanchions, said assembly pivotally attached to one of the stanchions for pivotal movement in a vertical plane at any of a selected one of the laterally-directed apertures thereof by insertion of said lever arm assembly pivot pin through a first lateral bore in said assembly and into said one of the laterally-directed apertures of said one of the stanchions, and said assembly including means for attaching said assembly to the other stanchion, said means permitting vertical travel of said means;

body engaging means;

means for attaching the body engaging means to the lever arm assembly; and means for suspending weights from the lever arm assembly.

2. The device of claim 1, wherein the lever arm assembly is pivotally attached to the front stanchion, the means for attaching said assembly to the other stanchion is attached to the rear, pivoting stanchion, and the means for suspending weights from the lever arm assembly is attached to a rear portion of the lever arm assembly.

3. The device of claim 2, wherein the means for suspending weights includes a rear beam that extends rearward from the rear stanchion, said rear beam having a second lateral bore, the body engaging means includes a front beam that extends frontward from the front stanchion, and the lever arm assembly includes a dolly cage intermediate the front and rear beams and joining them, said dolly cage being mounted for vertical travel up and down the rear, pivoting stanchion; and a safety spotter pin insertable through a selected one of the first set of apertures below the front beam for supporting the lever arm assembly.

4. The device of claim 3, wherein the dolly cage includes a pair of longitudinally-directed, laterally spaced-apart members, said members having front ends joined by a front spacer, and rear ends joined by a rear spacer, and a pair of rollers disposed intermediate the front and rear spacers and mounted for rotation on axles attached to the front and rear spacers, said rollers being longitudinally spaced apart to define an opening, in cooperation with the members, sufficient to receive the rear, pivoting stanchion therewithin, wherein the front spacer is attached to the front beam and the rear spacer is attached to the rear beam.

5. The device of claim 4, wherein the front and rear stanchions are tubes and are rectangular in horizontal cross-section.

6. The device of claim 5, wherein the members are tubes and are rectangular in vertical cross-section.

7. The device of claim 6, wherein the front beam, rear beam and spacers are tubes and are rectangular in vertical cross-section.

8. The device of claim 7, wherein the means for suspending weights from the rear beam includes a laterally-directed weight support bar suspended from the rear beam, which bar is adapted to receive and support a plurality of apertured weights.

9. The device of claim 3, wherein the means for attaching the body engaging means to the assembly includes a I bolt attached to a front portion of the front beam.

10. The device of claim 9, wherein the body engaging means includes a pull strap adapted for attachment to the I bolt.

11. The device of claim 10, wherein the body engaging means includes a grip bar adapted for attachment to the I bolt.

12. The device of claim 3, wherein the body engaging means includes a seat and back rest assembly for supporting a weight lifting trainee in an inclined, prone position under the rear beam, and a pair of hand grips attached to the rear beam.

13. The device of claim 9, wherein each of the apertures in the first and second sets of apertures are labeled with indicia.

14. The device of claim 9, wherein the body engaging means includes a first pulley attached to a front end portion of the lever arm assembly;

a second pulley attached to a front end portion of the base;

a cable having a proximal end and an opposite distal end, said distal end attached to a front end portion of the base and said cable extending from a front end portion of the base, through the first pulley, thence through the second pulley; and a quick release means attached to the proximal end of the cable for attaching a hand grip to the proximal end of the cable;

whereby a trainee positioned in front of the device can alternately raise and lower the weights attached to the rear beam by alternately pulling on and then relaxing the hand grip.

15. The device of claim 1, wherein the lever arm assembly is pivotally attached to the rear, pivoting stanchion, the means for attaching said assembly to the other stanchion is attached to the front stanchion, and the means for suspending weights from the lever arm assembly is attached to a front portion of the lever arm assembly.

16. The device of claim 15, wherein the front stanchion is a vertically moveable tube and the means for suspending weights from the lever arm assembly includes:

an upstanding frame attached to the base, said frame including a pair of laterally spaced-apart, vertical support columns, and a laterally-disposed cross bar attached to upper ends of the support columns, said cross bar carrying a horizontal header plate, said plate having an opening;

a pair of laterally spaced-apart guide rods that extend upward from the base to the header plate;

a stack pin rod intermediate the guide rods that extends downward from the front stanchion and has a free lower end, said stack pin rod having a plurality of vertically spaced-apart apertures;

a stack pin;

a weight stack comprised of a plurality of weight plates in vertical, stacked relation such that the upper weights of the stack rest upon the lower weights of the stack, each plate having a pair of laterally spaced-apart openings and a central opening, said weight stack being mounted for slidable, vertical movement along the guide rods and the stack pin rod, and each plate having a longitudinally-directed aperture adapted to receive the stack pin, such that insertion of the stack pin through a selected plate and through an aligned aperture of the stack pin rod attaches said plate, and all weight plates that rest thereon, to the front stanchion.

17. The device of claim 16, wherein the lever arm assembly includes a parallel pair of laterally spaced-apart longitudinal members joined at a rear end thereof by a rear member and joined at a front end thereof by a front member;

means for pivotally attaching a front portion of said assembly to the front stanchion; and means for pivotally attaching a rear portion of said assembly to the rear stanchion.

18. The device of claim 17, wherein the means for attaching a front portion of said assembly to the front stanchion includes an upstanding front collar disposed at a front portion of the assembly between the longitudinal members and rear-adjacent to the front member, said collar defining an opening adapted to receive and encircle the front stanchion, said collar having a laterally-directed front collar bore and a pair of laterally and oppositely-directed studs;

a front collar pin inserted through the front collar bore and insertable into any one of the front set of apertures for pivotally attaching the assembly to the front stanchion; and wherein the means for attaching a rear portion of said assembly to the rear stanchion includes an upstanding rear collar disposed at a rear portion of the assembly between the longitudinal members and front-adjacent to the rear member, said collar defining an opening adapted to receive and encircle the rear stanchion, said collar having a laterally-directed rear collar bore and a pair of laterally and oppositely-directed studs, and a rear collar pin inserted through the rear collar bore and insertable into any one of the second set of apertures for pivotally attaching the assembly to the rear stanchion; and wherein further the longitudinal members have apertures or recesses that receive said studs;

whereby the collars are pivotable in a vertical plane about said studs, the front portion of the assembly can travel up and down with the pivotally attached front stanchion together with such portion of the weight stack that is attached to the front stanchion, and the rear portion of the assembly is pivotally attached to the rear stanchion.

19. The device of claim 18, wherein the rear stanchion is a tube, the front and rear stanchions are each rectangular in horizontal cross-section, and the front and rear collars are each rectangular in vertical cross-section.

20. The device of claim 19, wherein the front and rear members are tubes and are rectangular in vertical cross-section.

21. The device of claim 20, wherein the longitudinal members are angle irons with apertures or recesses for receiving the collar studs.

22. The device of claim 16, wherein the body engaging means includes a cable having a proximal end and an opposite distal end;

quick release means attached to a rear end portion of the lever arm assembly for attaching the distal end of the cable to said rear end portion;

pulley means attached to the base for routing the cable forward of the weight stack and for facilitating reciprocal movement of the cable; and at least one hand grip attached to the proximal end of the cable;

whereby a trainee positioned in front of the weight stack and grasping said hand grip can alternately raise and lower the weight stack, or a selected portion thereof, by alternately pulling and then relaxing the hand grip.

23. The device of claim 22, wherein the quick release means includes a I bolt attached to, and depending from, the front end portion of the lever arm assembly and a quick release clip attachable to said I bolt and attachable to said body engaging means.

24. The device of claim 23, wherein the pulley means comprises a first pulley attached to a front portion of the base and a second pulley attached to a rear portion of the base.

25. The device of claim 16, wherein the body engaging means includes a pair of handgrips suspended by straps.

26. The device of claim 16, wherein the body engaging means includes a lift arm, said lift arm including a laterally spaced-apart pair of arms having front portions joined by a bight portion.

27. The device of claim 26, wherein the body engaging means further includes a cylindrical cushion mounted on each arm.

28. The device of claim 16, wherein each of the apertures in the first and second sets of apertures are labeled with indicia.

* * * * *